US010175029B2

(12) United States Patent
Teetzel et al.

(10) Patent No.: US 10,175,029 B2
(45) Date of Patent: Jan. 8, 2019

(54) COMBINED REFLEX AND LASER SIGHT WITH CO-ALIGNED IRON SIGHTS

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 15/403,681

(22) Filed: Jan. 11, 2017

(65) Prior Publication Data

US 2017/0205194 A1 Jul. 20, 2017

Related U.S. Application Data

(60) Provisional application No. 62/279,244, filed on Jan. 15, 2016.

(51) Int. Cl.
*F41G 1/30* (2006.01)
*F41G 1/01* (2006.01)
(Continued)

(52) U.S. Cl.
CPC ..... *F41G 1/30* (2013.01); *F41G 1/01* (2013.01); *F41G 1/02* (2013.01); *F41G 1/06* (2013.01);
(Continued)

(58) Field of Classification Search
CPC ..... F41G 1/16; F41G 1/20; F41G 1/24; F41G 1/28; F41G 1/01; F41G 1/02; F41G 1/06;
(Continued)

(56) References Cited

U.S. PATENT DOCUMENTS 2,105,564 A * 1/1938 Vaver ..... F41G 1/28 42/137
4,977,676 A * 12/1990 Toupin ..... F41G 1/18 42/138
(Continued)

FOREIGN PATENT DOCUMENTS

WO 2015032843 A2 3/2015
WO 2017123914 A1 7/2017

OTHER PUBLICATIONS

International Search Report and Written Opinion dated May 15, 2017, received in PCT/US2017/013392.
(Continued)

*Primary Examiner* — Bret Hayes
(74) *Attorney, Agent, or Firm* — McLane Middleton, Professional Association

(57) ABSTRACT

A combined reflex and laser sighting device with co-aligned iron sights is provided. In one aspect, the laser elements are co-aligned with each other, the reflex sight is co-aligned with the laser elements, and the iron sights are then co-aligned with the reflex sight and lasers, such that both the reflex sight, laser sight, and iron sights can all be calibrated or boresighted to a weapon together in a single operation. In another aspect, one or more laser elements are mounted to a laser bench and aligned with a reflex sight and iron sights attached to the laser bench. In yet another aspect, a plurality of laser elements are provided on the laser bench and are co-aligned with each other, the reflex sight, and the iron sights. In yet another aspect, an elevation adjustment apparatus for a laser sight includes selectable primary and secondary adjustment assemblies.

7 Claims, 25 Drawing Sheets

(51) Int. Cl.

| | |
|---|---|
| ***F41G 1/02*** | (2006.01) |
| ***F41G 1/06*** | (2006.01) |
| ***F41G 1/34*** | (2006.01) |
| ***F41G 1/36*** | (2006.01) |
| ***F41G 1/44*** | (2006.01) |
| ***F41G 1/26*** | (2006.01) |
| ***F41G 1/35*** | (2006.01) |

(52) U.S. Cl.
CPC ..... *F41G 1/26* (2013.01); *F41G 1/345* (2013.01); *F41G 1/35* (2013.01); *F41G 1/36* (2013.01); *F41G 1/44* (2013.01)

(58) Field of Classification Search
CPC ... F41G 1/26; F41G 1/30; F41G 1/345; F41G 1/35; F41G 1/36; F41G 1/44
USPC ..... 42/115, 125, 126, 135, 136
See application file for complete search history.

(56) References Cited

U.S. PATENT DOCUMENTS

| | | | | |
|---|---|---|---|---|
| 8,561,518 | B2 | 10/2013 | Teetzel et al. | |
| 2008/0216379 | A1 | 9/2008 | Javorsky | |
| 2009/0199452 | A1* | 8/2009 | Huber | F41G 1/38 42/125 |
| 2012/0102808 | A1 | 5/2012 | Matthews et al. | |
| 2015/0198415 | A1 | 7/2015 | Campean | |
| 2015/0345901 | A1 | 12/2015 | Cheng et al. | |
| 2016/0010949 | A1 | 1/2016 | Teetzel et al. | |
| 2016/0102943 | A1 | 4/2016 | Teetzel et al. | |
| 2016/0313089 | A1* | 10/2016 | Collin | F41G 1/30 |

OTHER PUBLICATIONS

Machine Translation of WO2015/032843 published Mar. 12, 2015, received in PCT/US2017/013392.

* cited by examiner

SECTION A-A

COMBINED REFLEX AND LASER SIGHT WITH CO-ALIGNED IRON SIGHTS

CROSS REFERENCE TO RELATED APPLICATION

This application claim the priority benefit of U.S. provisional application No. 62/279,244 filed Jan. 15, 2016. The aforementioned application is incorporated herein by reference in its entirety.

BACKGROUND

The present disclosure relates to the field of projectile weapon sights and, in particular, to a combined reflex and laser sight having co-aligned iron sights. The weapon may be a rifle or other firearm, or other ballistics projectile launcher.

Reflex sights are generally known in the art and typically include a battery-powered light source such as an LED or laser for projecting an illuminated reticle image, such as a red dot. Such reflex sights include a lens assembly (typically non-magnifying), e.g., employing a beam splitter or dichroic mirror allowing the user to view a target field of view. The lens assembly contains a reflective coating or film that reflects light from the light source along the viewing axis of the lens so that the viewer sees both the target field of view and projected reticle image superimposed thereon to aid the user in aiming the barrel of a firearm or other projectile weapon. Laser sights are also known and comprise one or more laser devices configured to emit a laser beam onto a target for the purpose of aiding the user in aiming the barrel of a firearm or other weapon.

In each case, the alignment of the sight must be adjusted with respect to the barrel of the weapon (bore sighted) so that the position of the emitted light (i.e., the reticle image on the lens in the case of a reflex sight or the position of the laser beam on the target in the case of a laser sight) corresponds with or intersects the trajectory path of the fired projectile at the target. The process of adjusting the alignment of the sight to reconcile the point of aim with the point of impact typically involves adjusting the horizontal alignment (windage) and vertical alignment (elevation) using threaded adjustment screws. The process of adjusting the alignment of a sight relative to the barrel of a weapon must also take into account a number of factors, including the fact that the sight is offset from the axis of the barrel and the fact that a beam emitted by a laser module will travel in a straight line whereas the projectile will follow a ballistics trajectory and, thus, can be a time consuming process. In the case of multiple sights, the horizontal and vertical alignment must be performed for each sight.

In addition, even when a sight has been bore sighted for a particular weapon, it may be necessary to re-bore sight for different conditions, including changes in distance to target (for example, long range vs. short range or close combat conditions), differences in muzzle velocity or projectile speed for different types of ammunition rounds), and changes in incline (e.g., level shooting vs. elevated or depressed firing position relative to target), and so forth.

Iron sights refer to a system of fixed or adjustable physical or mechanical alignment markers used to assist in the aiming of a firearm and commonly include a rear sight, such as a notch or ring, mounted perpendicular to the line of sight and a front sight, such as a post, bead, or ring. Although iron sights lack the precision of a laser sight or optical sight (e.g., reflex sight or telescopic sight), iron sights may still be provided alongside other sighting devices, e.g., for backup usage. However, even when a firearm is equipped with one or more precision sights such as a laser sight and/or optical sight as well as iron sights, the iron sights are not typically co-aligned with the precision sight. Even in the case of adjustable iron sights that can be adjusted for elevation and windage, the iron sights are not typically co-aligned with the precision sights, such that the iron sights and the precision sight must be separately bore sighted to the weapon.

The present disclosure contemplates a new and improved sight apparatus including a combined reflex sight and laser sight in combination with iron sights wherein the reflex sight, laser sight, and iron sights are co-aligned on a single laser bench such that all three sights can be bore sighted to the weapon together.

SUMMARY

An integrated sight for a weapon is provided, the weapon being of a type having a barrel for firing projectiles, the barrel defining a longitudinal bore axis. The integrated sight includes one or more lasers, a reflex sight, and iron sights on a single laser bench or suite.

A laser sight assembly for a projectile weapon includes a housing for engaging a portion of the projectile weapon and a laser module for emitting a beam along an optical axis. The laser module mounted to a laser bench. A reflex sight assembly is rigidly attached to the laser bench and includes a light source for generating an aiming mark and an optical element. The aiming mark is reflected in the optical element, wherein the optical axis of the laser module and the aiming mark of the reflex sight are substantially coaligned. An elevation adjustment assembly includes an elevation adjustment screw rotatably supported on the housing, which bears against the laser bench and is operable to adjust a position of the laser bench about a horizontal axis. A windage adjustment assembly includes a windage adjustment screw rotatably supported on the housing, the windage adjustment screw bearing against the laser bench. The windage adjustment screw is operable to adjust a position of the laser bench about a vertical axis.

An elevation adjustment apparatus for a laser sight for a projectile weapon, the laser sight including a housing and a laser bench movably secured with the housing, comprises a throw lever pivotally attached to the housing and movable between a first position and a second position. A primary adjustment assembly cooperates with the laser bench to adjust an aim point of the laser sight to a first vertical position when the throw lever is moved to the first position. A secondary adjustment assembly cooperates with the laser bench to adjust the aim point of the laser sight to a second vertical position when the throw lever is moved to the second position.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
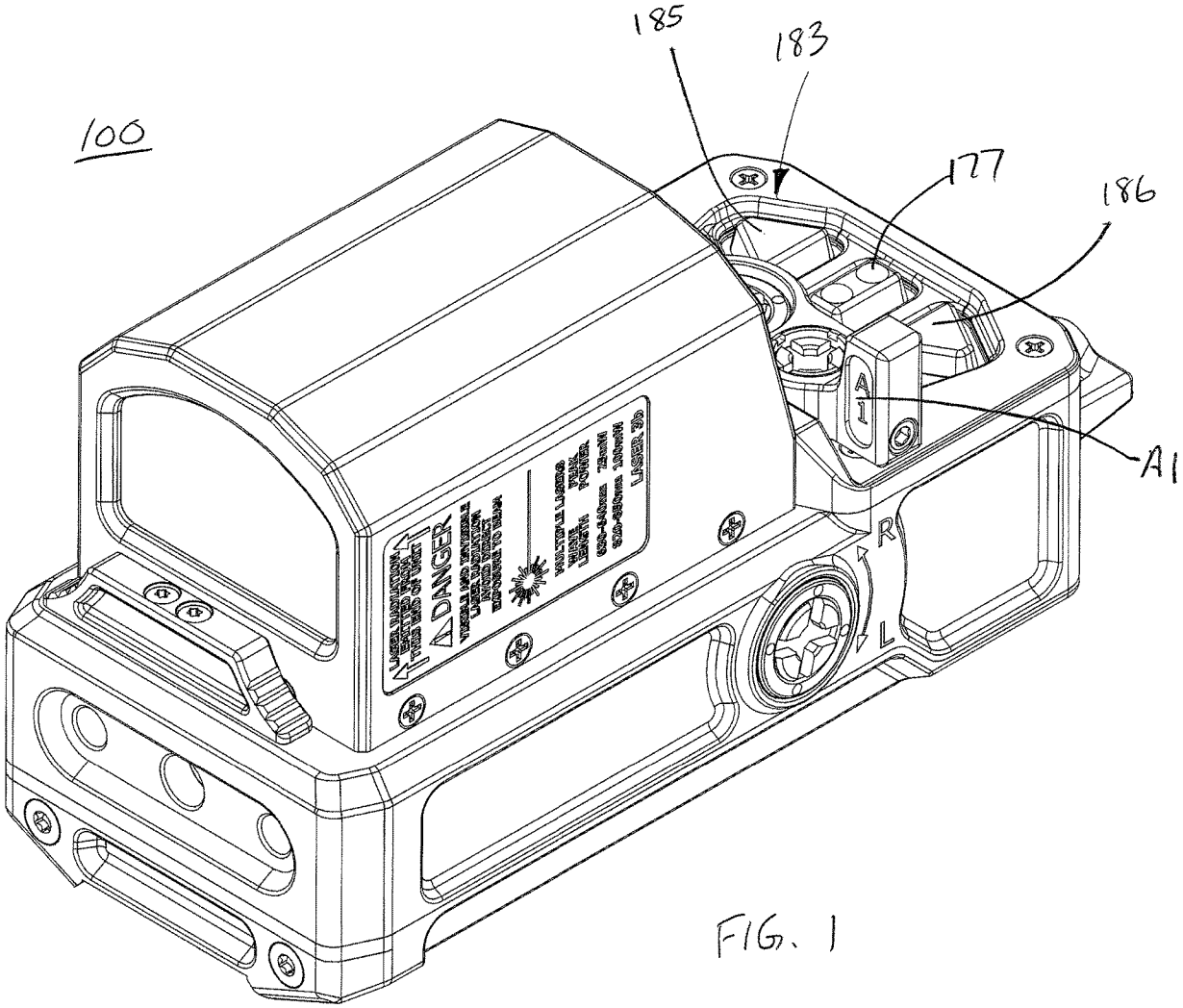
FIG. 1 is an isometric view of a combined laser and reflex aiming sight with integrated iron sights in accordance with an exemplary embodiment of the invention, taken generally from above, the front, and the right side.
Figure 2:
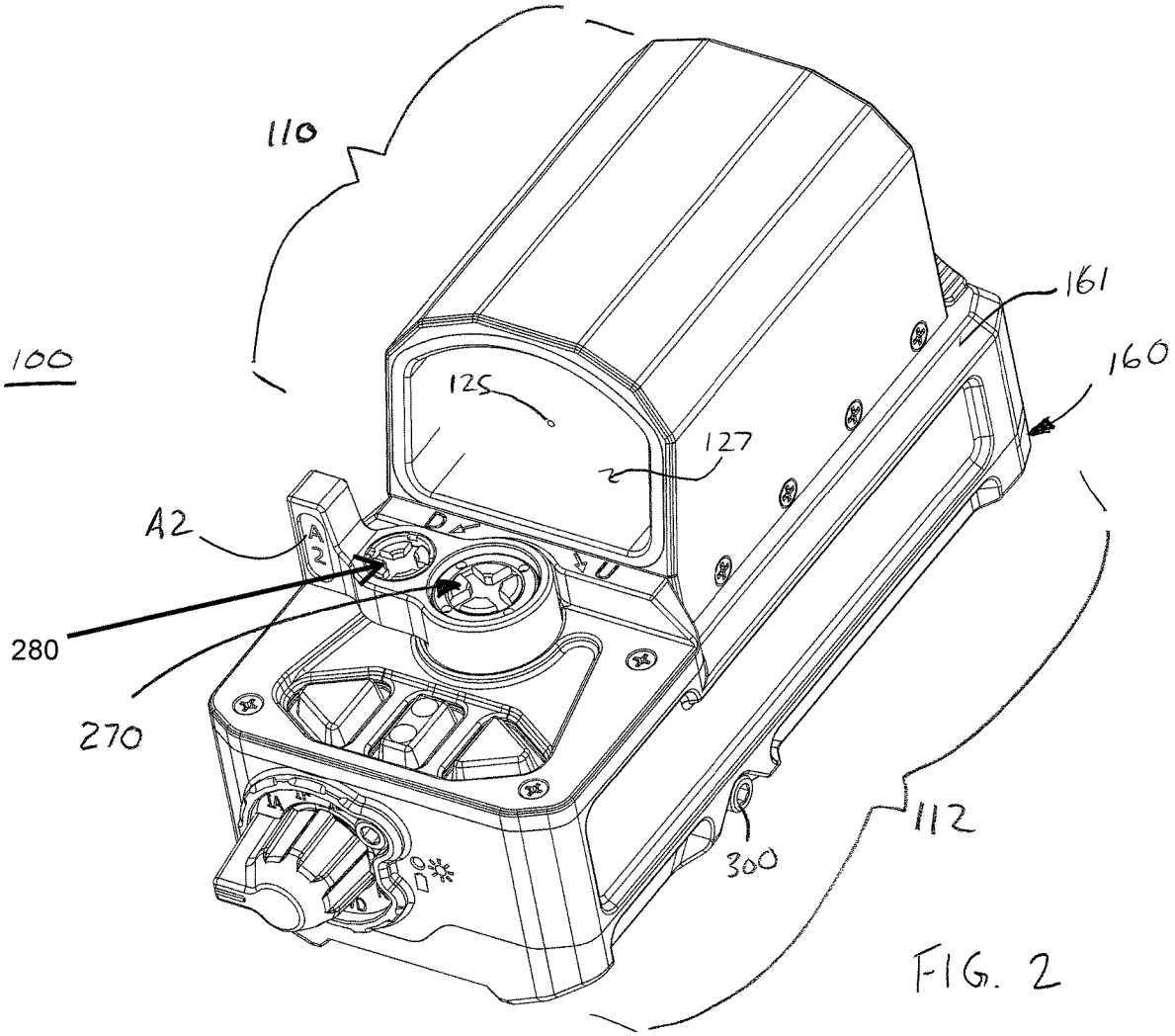
FIG. 2 is an isometric view of the combined laser and reflex aiming sight with integrated iron sights appearing in FIG. 1, taken generally from above, the rear, and the left side.
Figure 3:
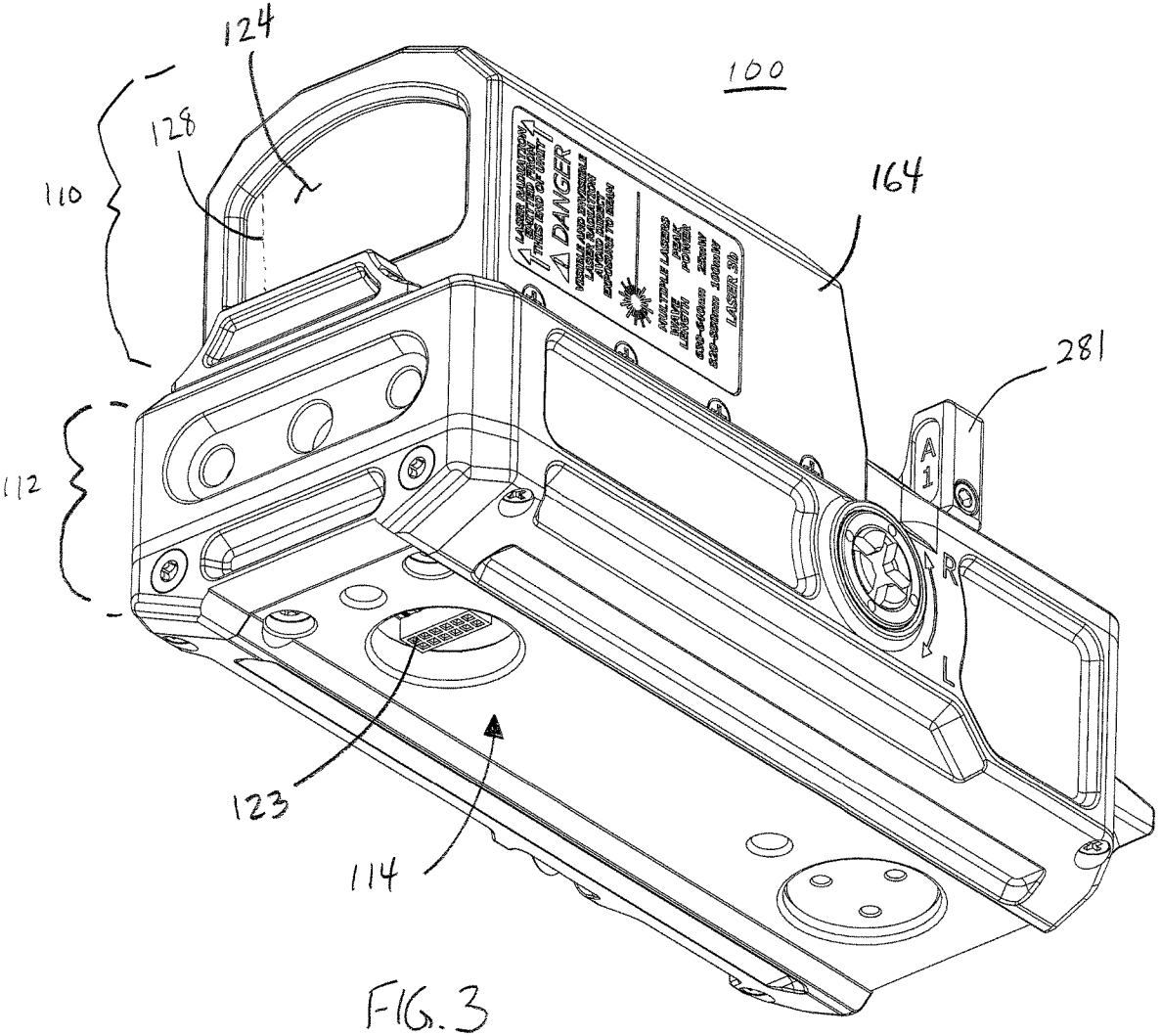
FIG. 3 is an isometric view of the combined laser and reflex aiming sight with integrated iron sights appearing in FIG. 1, taken generally from below, the front, and the right side.
Figure 4:
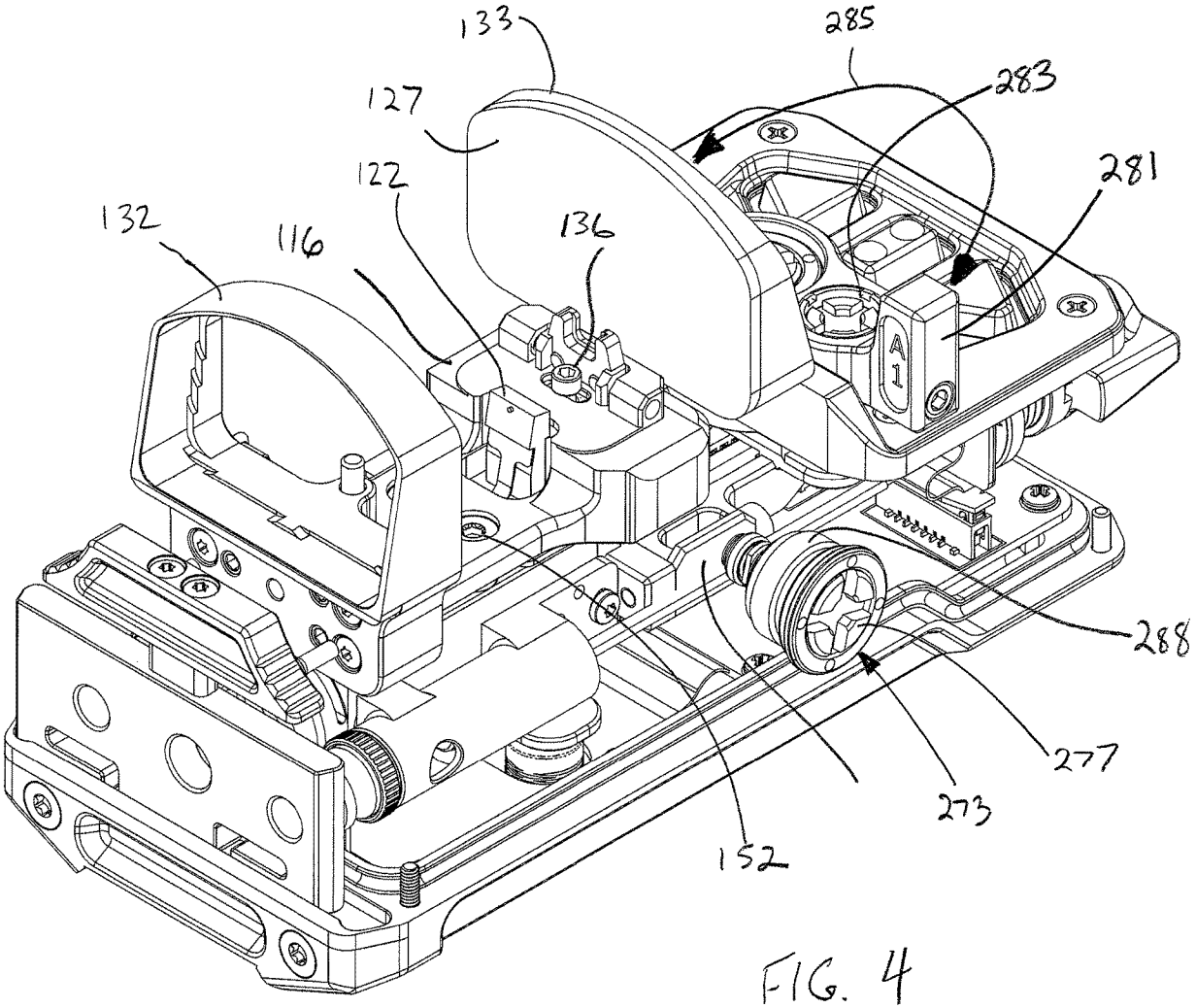
FIG. 4 is an isometric view of the combined laser and reflex aiming sight with integrated iron sights appearing in FIG. 1, with portions of the housing covers removed.
Figure 5:
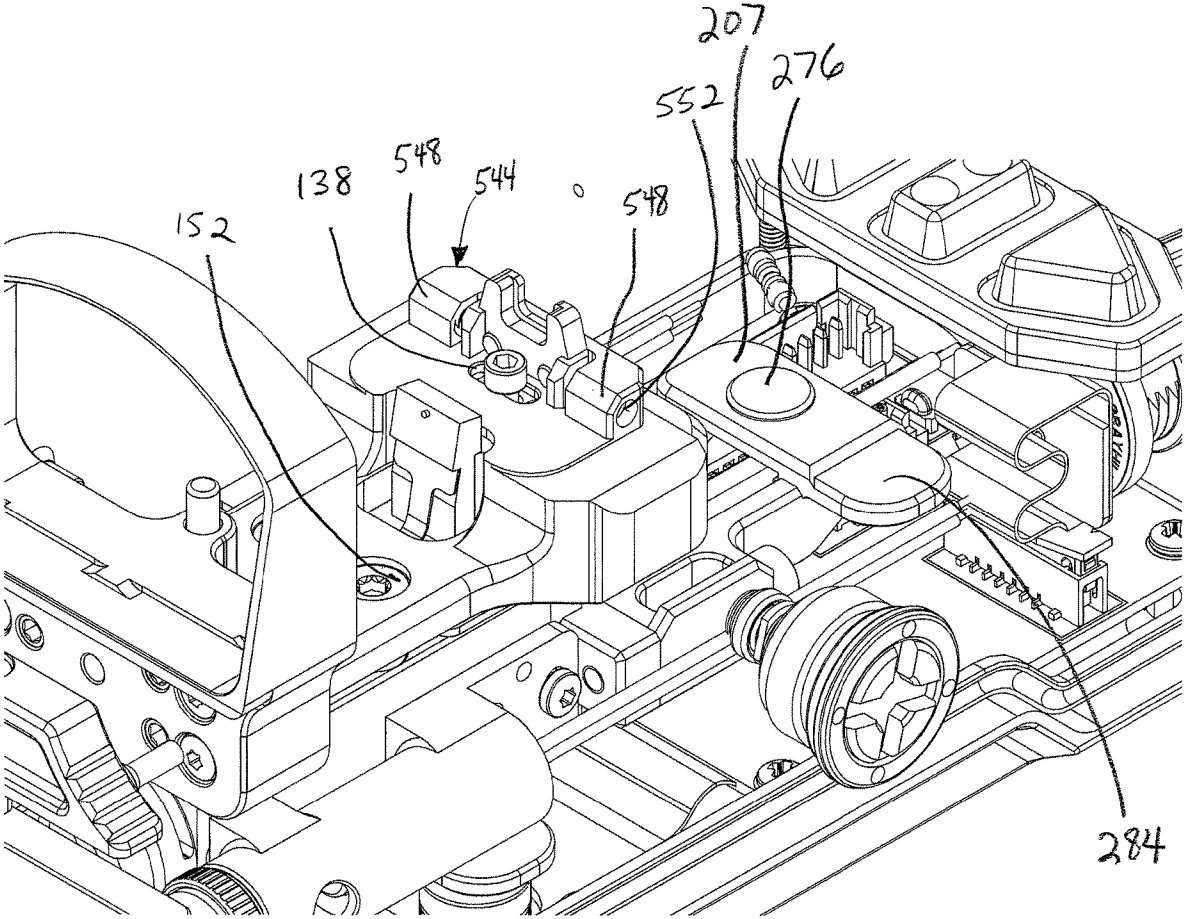
FIG. 5 is an enlarged, fragmentary, isometric view of the unit showing the iron sights, taken generally from above, the front, and the right side.
Figure 6:
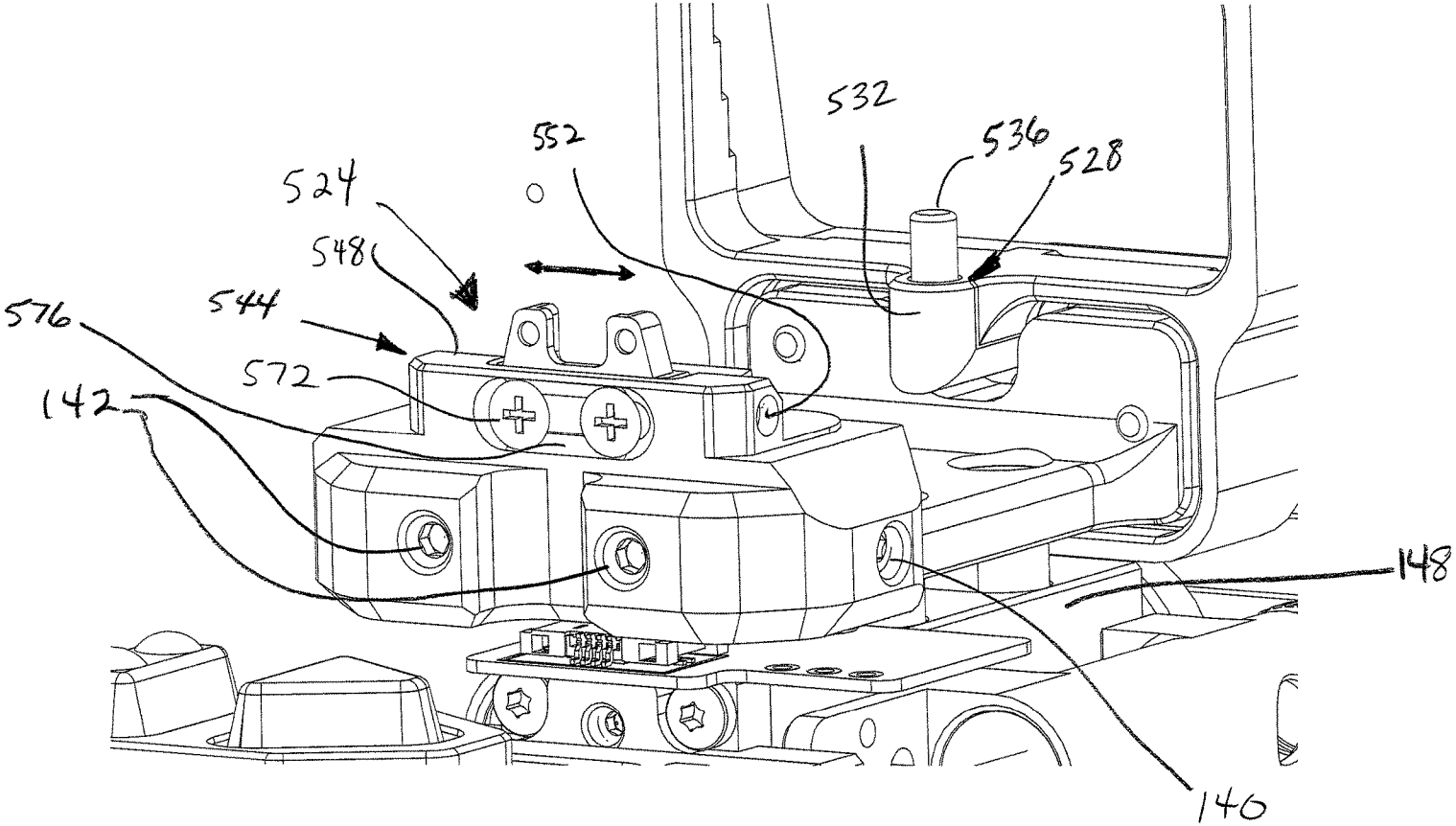
FIG. 6 is an enlarged isometric view of the unit showing the iron sights, taken generally from the rear and left side.
Figure 7:
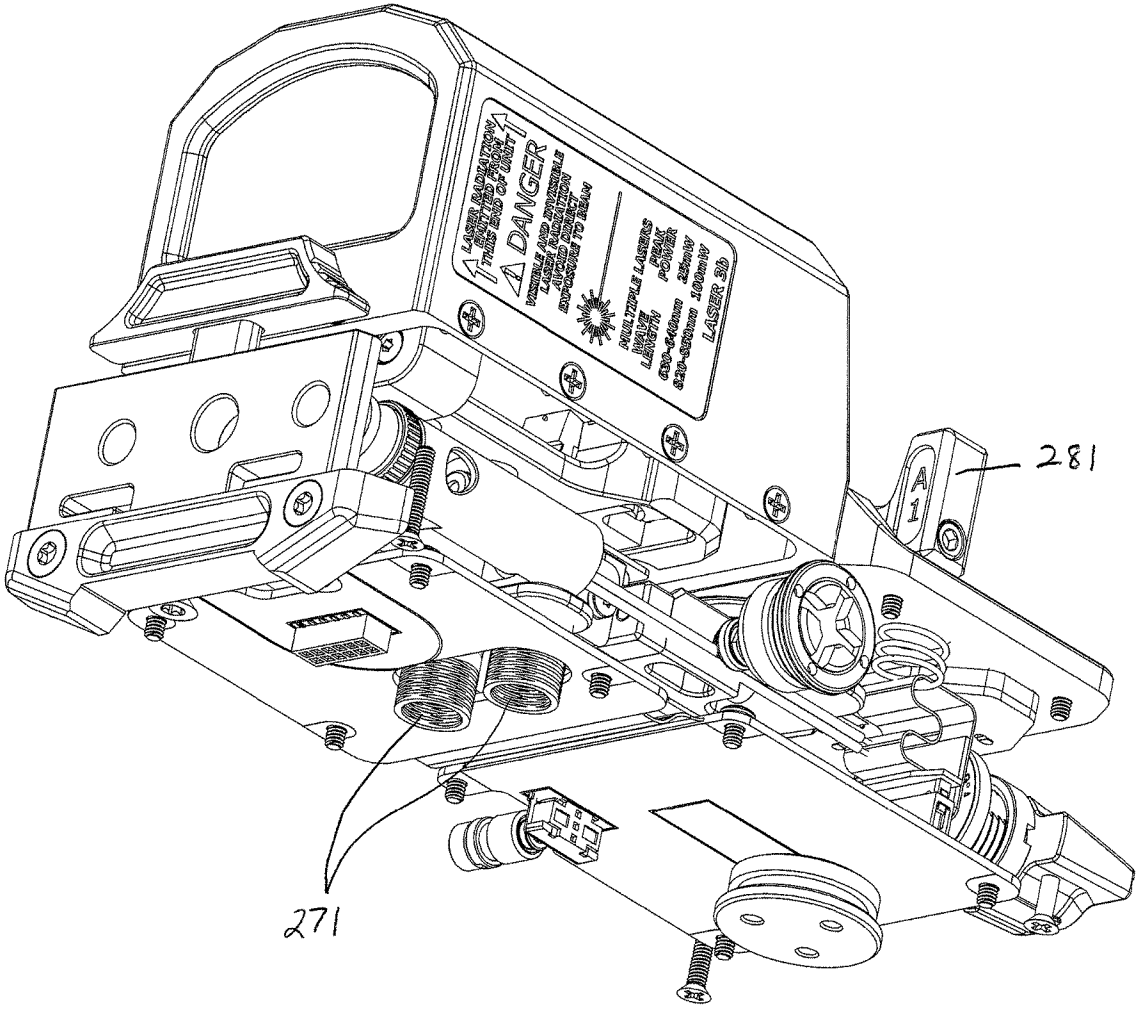
FIG. 7 is an isometric view of the unit with portions of the housing covers removed, taken generally from below, the front and the right side.
Figure 8:
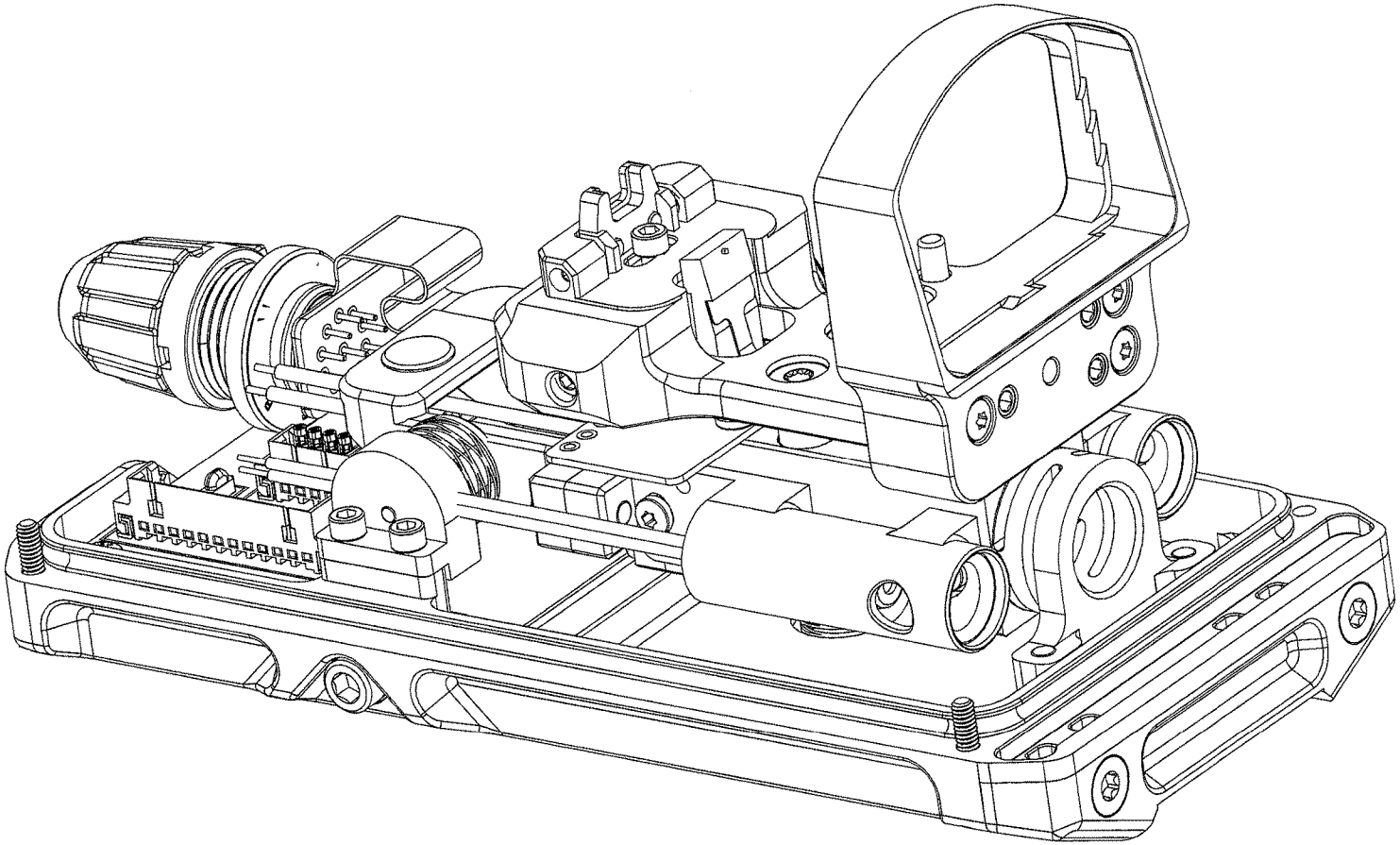
FIG. 8 is an isometric view of the unit with portions of the housing covers removed, taken generally from the left side.
Figure 9:
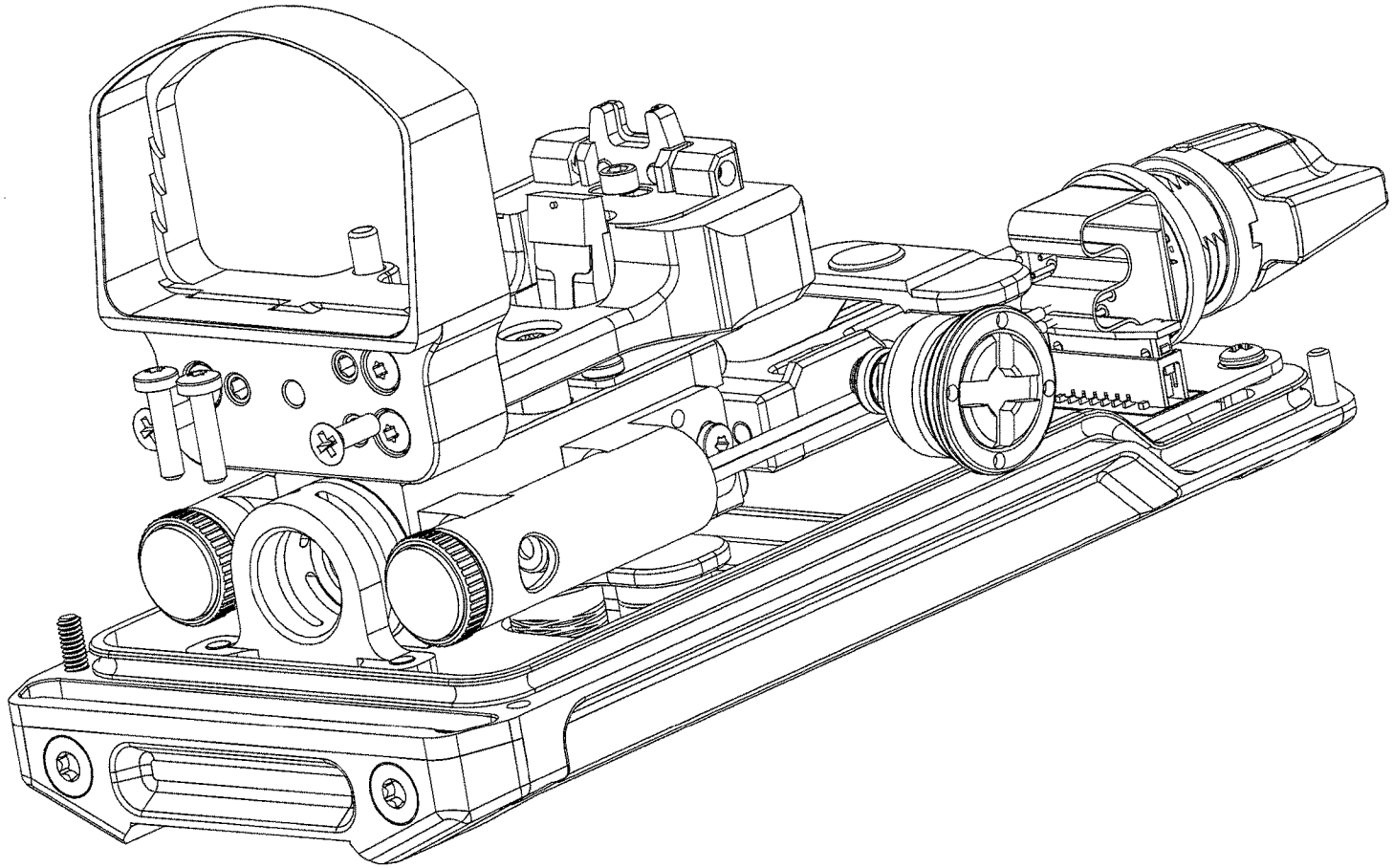
FIG. 9 is an isometric view of the unit with portions of the housing covers removed, taken generally from the front and the right side.
Figure 10:
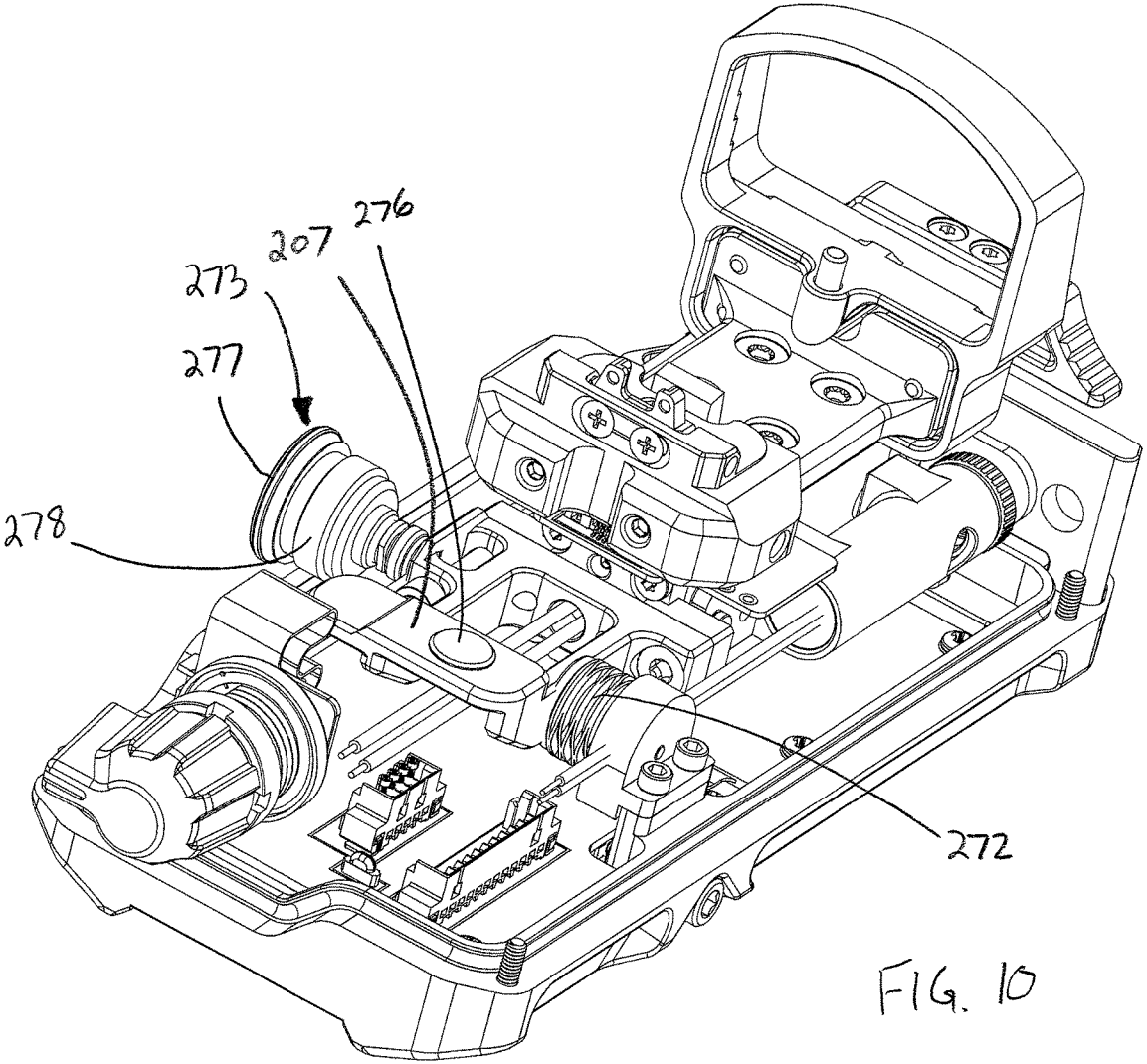
FIG. 10 is an isometric view of the unit with portions of the housing covers removed, taken generally from the rear and the left side.
Figure 11:
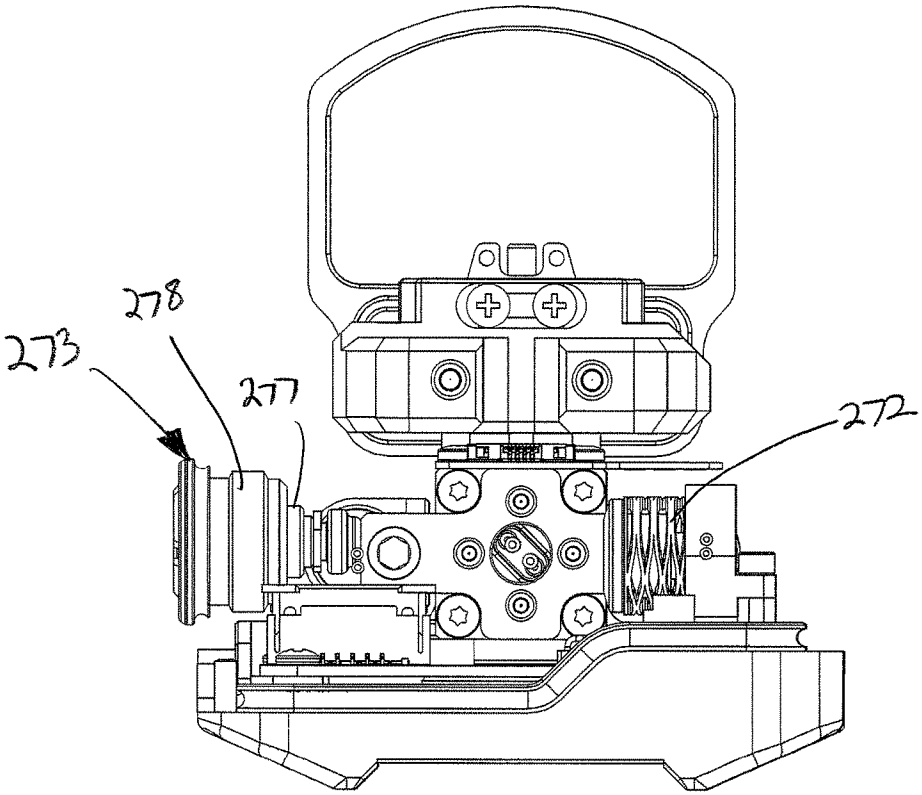
FIG. 11 is a rear view of the unit with portions of the housing covers removed.
Figure 12:
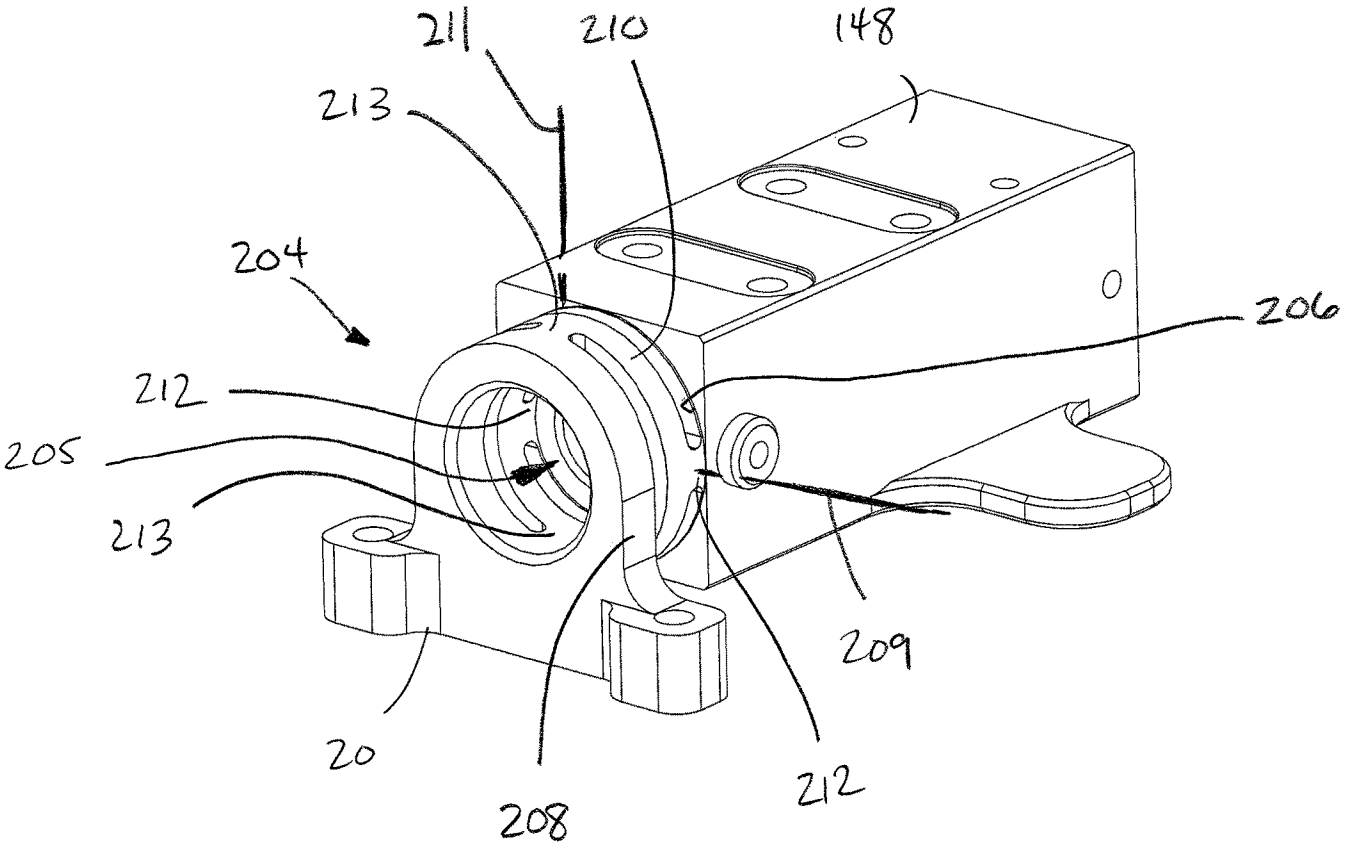
FIG. 12 is an enlarged view of the laser bench and mounting block.

Referring now to the drawings, wherein like reference numerals refer to like components throughout the several views, FIGS. 1-25 illustrate a combined aiming and reflex sight 100 with iron sights, which includes a reflex sight assembly 110 and a laser sight assembly 112. In certain embodiments, the reflex sight assembly 110 and the laser sight assembly 112 are combined into an integrated device.

For purposes of this disclosure, the relative terms left, right, front, rear, top, bottom, up, down, horizontal, vertical, etc. are based on the perspective of a person facing the front of the unit. The reflex sight and laser sight in the depicted embodiment may generally be as described in commonly-owned U.S. publication no. 2016/0102943 published Apr. 14, 2016 (application Ser. No. 14/881,779 filed Oct. 13, 2015), the entire contents of which are incorporated herein by reference.

The reflex sight assembly 110 includes a base 116 and a cover 164. A light source 122 such as an LED or laser, e.g., an eye-safe laser, is received within the base 116. The light source 122 emits light that impinges on a lens assembly 124. The lens assembly 124 functions as a partially reflective mirror (e.g., beam splitter or dichroic mirror), for example, which may include a reflective coating or film 128 therein to reflect light from the light source 122 back toward the user. The light from the light source is preferably collimated 122, e.g., using a collimating lens. The lens assembly 124 also allows light reflected from the target field of view to pass through, wherein the collimated light from the light source 122 appears as a superimposed aiming mark or reticle on the target field of view. The superimposed aiming mark may appear as a dot 125, e.g., a red or green dot, viewed through a rear lens or window 127. It will be recognized that other reticle shapes, such as rings, cross hairs, and the like, are also contemplated.

A lens retainer 132 secures the reflex sight lens assembly 124 to the base 116. A rear lens retainer 133 secures the rear lens 127 to the base 116. In certain embodiments, the vertical position of the collimated light from the light source 122 on the lens assembly 124 is adjusted using a threaded adjustment screw 136 received through elongated opening 138 and the horizontal position of the collimated light from the light source 122 on the lens assembly 124 is adjusted using a threaded adjustment screw 140 against the bias of a spring 141 to provide elevation and windage adjustments for the reflex sight. Once the light source 122 and the lasers elements of the laser sight (described in greater detail below), have been co-aligned, screws 142 (see FIG. 6) are tightened to maintain the light source 122 in its coaligned position.

The base 116 is secured to a laser bench 148 via threaded fasteners 152. The cover 164 is secured over the reflex sight assembly 110 and in certain embodiments is secured via threaded fasteners to an upper section 161 of the laser module housing 160.

Figure 17:
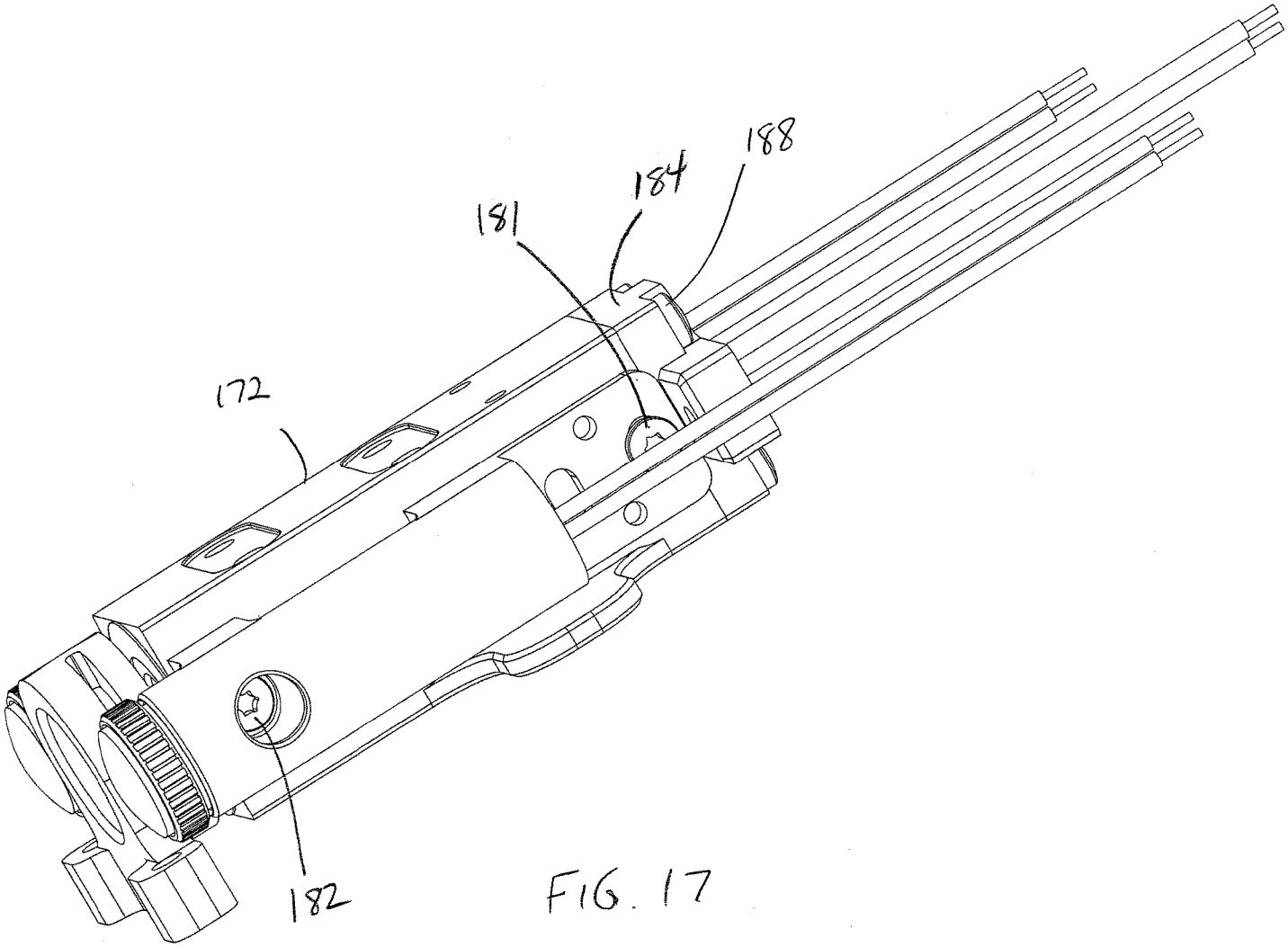
FIG. 17 is a generally side view of the laser bench assembly.
Figure 18:
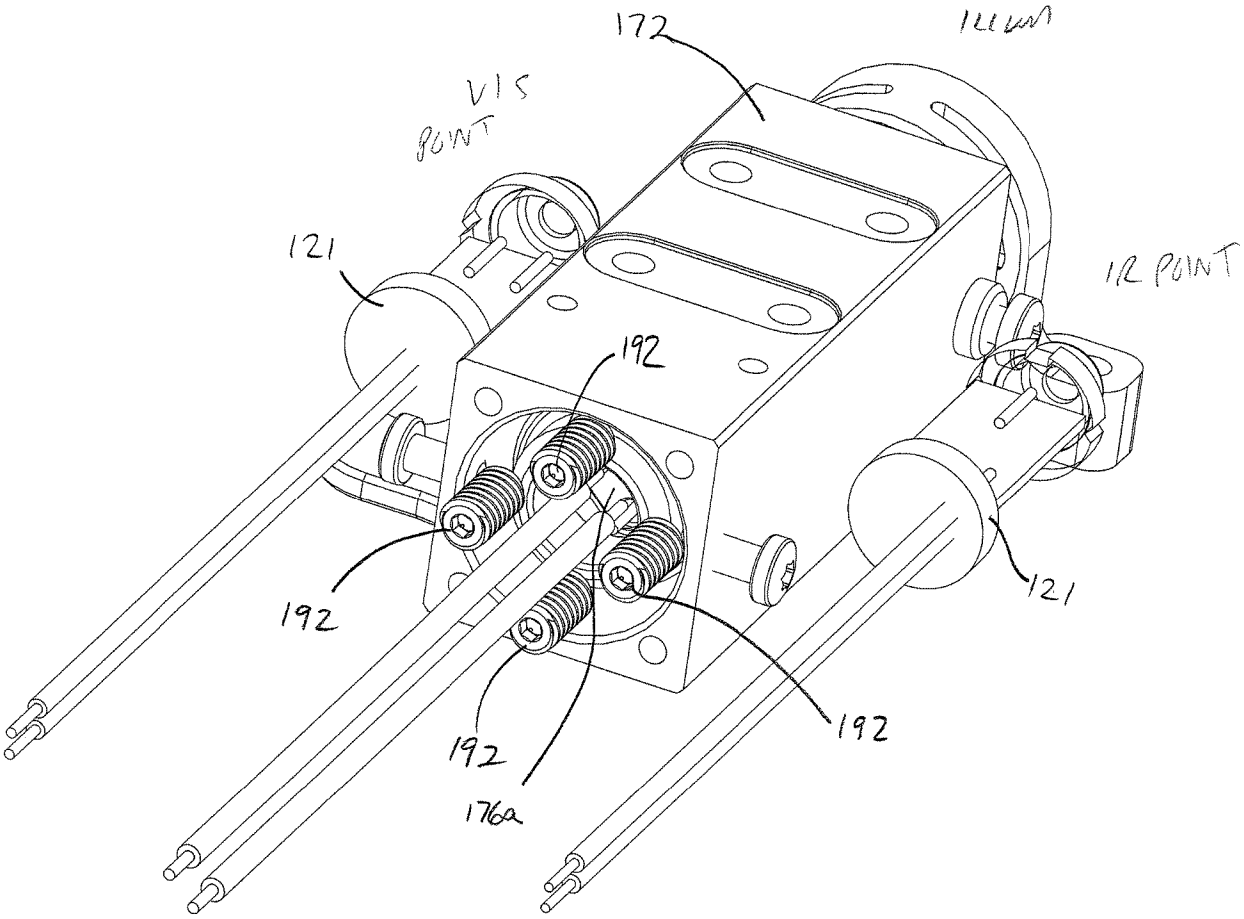
FIGS. 18 and 19 are generally rear views of the laser bench assembly.
Figure 19:
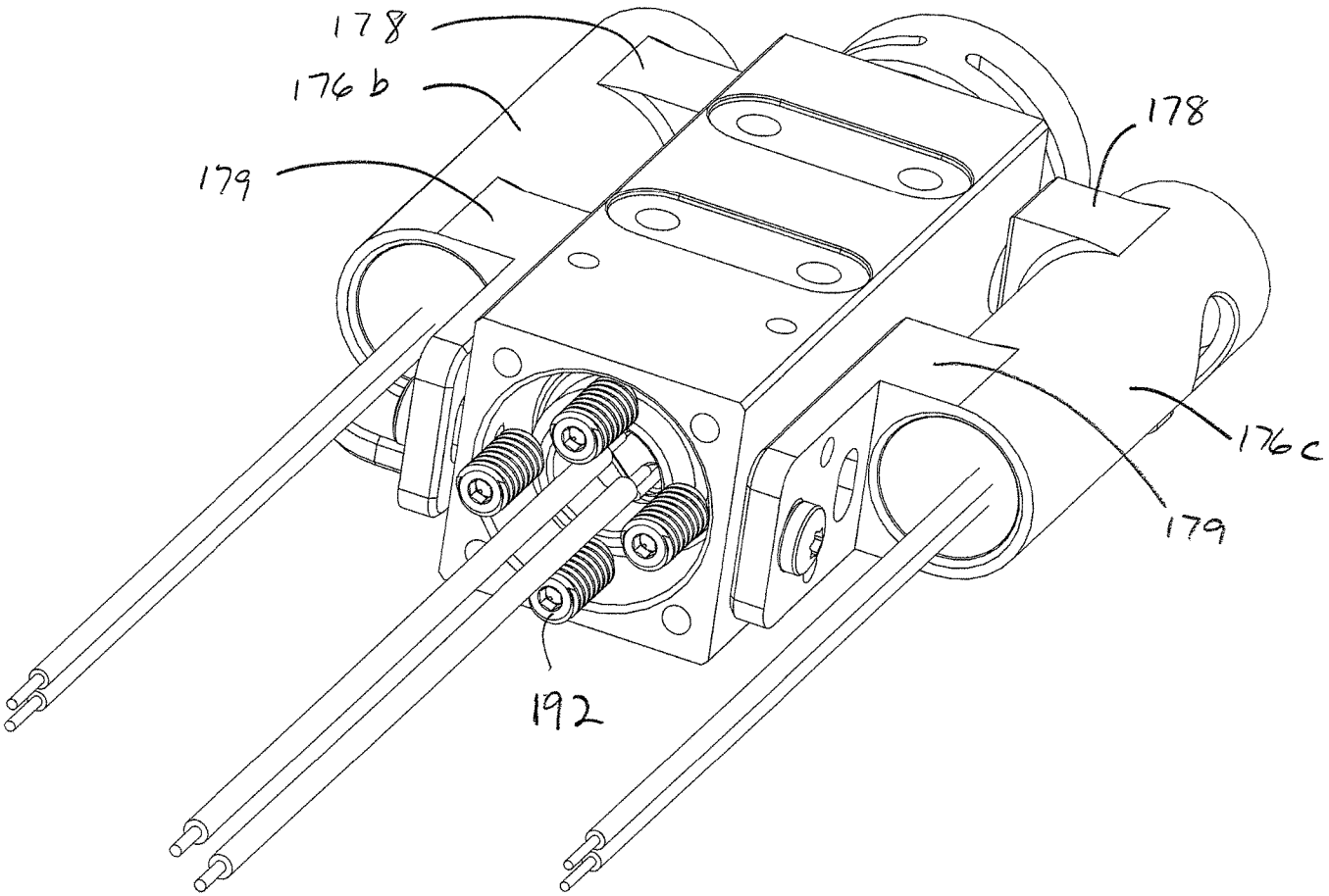
Figure 20:
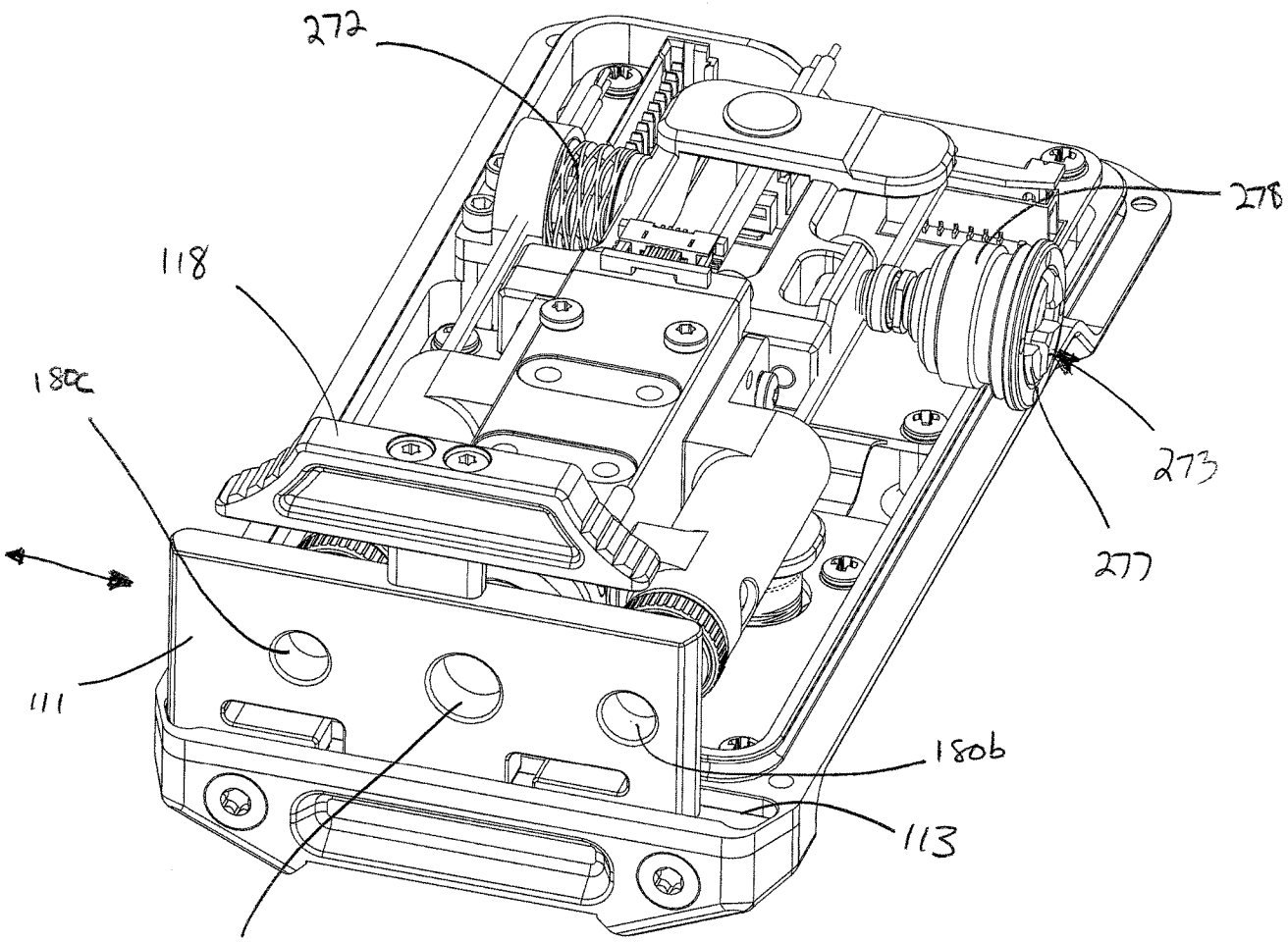
FIG. 20 is an isometric view illustrating the laser safety door.

In certain embodiments, and as best seen in FIGS. 17 and 18, the laser bench 148 includes a center section 172 having a generally cylindrical opening receiving a laser tube **176*a*. In certain embodiments, the laser tube 176*a*** is an infrared (IR) illuminator. Preferably, the flood laser has a fixed flood width, although focusing optics for selectively narrowing or broadening the flood beam are also contemplated.

The laser bench 148 includes a rear cover 184, which retains the laser tube **176*a* within the bench 148 and is secured to the bench with threaded fasteners 188. The optical axis of the laser 176*a* relative to the optical bench 148 and/or the other attached lasers can be adjusted in both the vertical and horizontal directions by selectively advancing or retracting the 4 set screws 192 which are radially spaced around the optical axis of the laser 176*a***, e.g., in 90-degree intervals.

A second laser tube 176*b*, which may be, for example, a visible pointing laser, is secured to one side of the laser bench. The laser tube 176*b* includes a front mounting bracket 178 and a rear mounting bracket 179. The rear bracket is secured to the bench via a threaded fastener 181 and the front bracket is secured to the bench via a threaded fastener 182.

A third laser tube 176*c*, which may be, for example, an infrared pointing laser, is secured to the other side of the laser bench. The laser tube 176*c* includes a front mounting bracket 178 and a rear mounting bracket 179. The rear bracket is secured to the bench via a threaded fastener 181 and the front bracket is secured to the bench via a threaded fastener 182.

One or both of the threaded fasteners 181, 182 may pass though elongate or oversize openings in the respective bracket to allow coalignment of the optical axis of each the lasers 176*b*, 176*c* in the vertical direction with the optical bench and/or the other lasers. Selective advancement and retraction of the threaded fasteners 181, 182 in the transverse direction allow coalignment of the optical axis of each the lasers 176*b*, 176*c* in the horizontal direction with the optical bench and/or the other lasers.

Once the laser tubes 176*a*, 176*b*, and 176*c* are all coaligned, a potting compound 121 may be used within the respective laser tubes to maintain the positions of the lasers 176*a*, 176*b*, and 176*c* in their coaligned state.

In preferred embodiments, the IR flood and the IR pointing laser are operable individually, as well as together wherein a dot of higher intensity is visible within the flooded area when using night vision equipment.

A sliding laser safety door 111 is slidably received within a slot 113 formed in a base shell 117 of the housing 160. The door 111 is slidable in the transverse direction between an open position and a closed position. The door includes apertures 180*a*, 180*b*, and 180*c*, which are aligned with the beams emitted by the respective laser tubes 176*a*, 176*b*, and 176*c* when the door is in the open position. The apertures 180*a*, 180*b*, and 180*c* are moved out of alignment the respective laser tubes 176*a*, 176*b*, and 176*c* when the door is in the closed position. A door pull 118 attached to the door 111 is manually slidable by the user to move the door between the open and closed positions.

Figure 21:
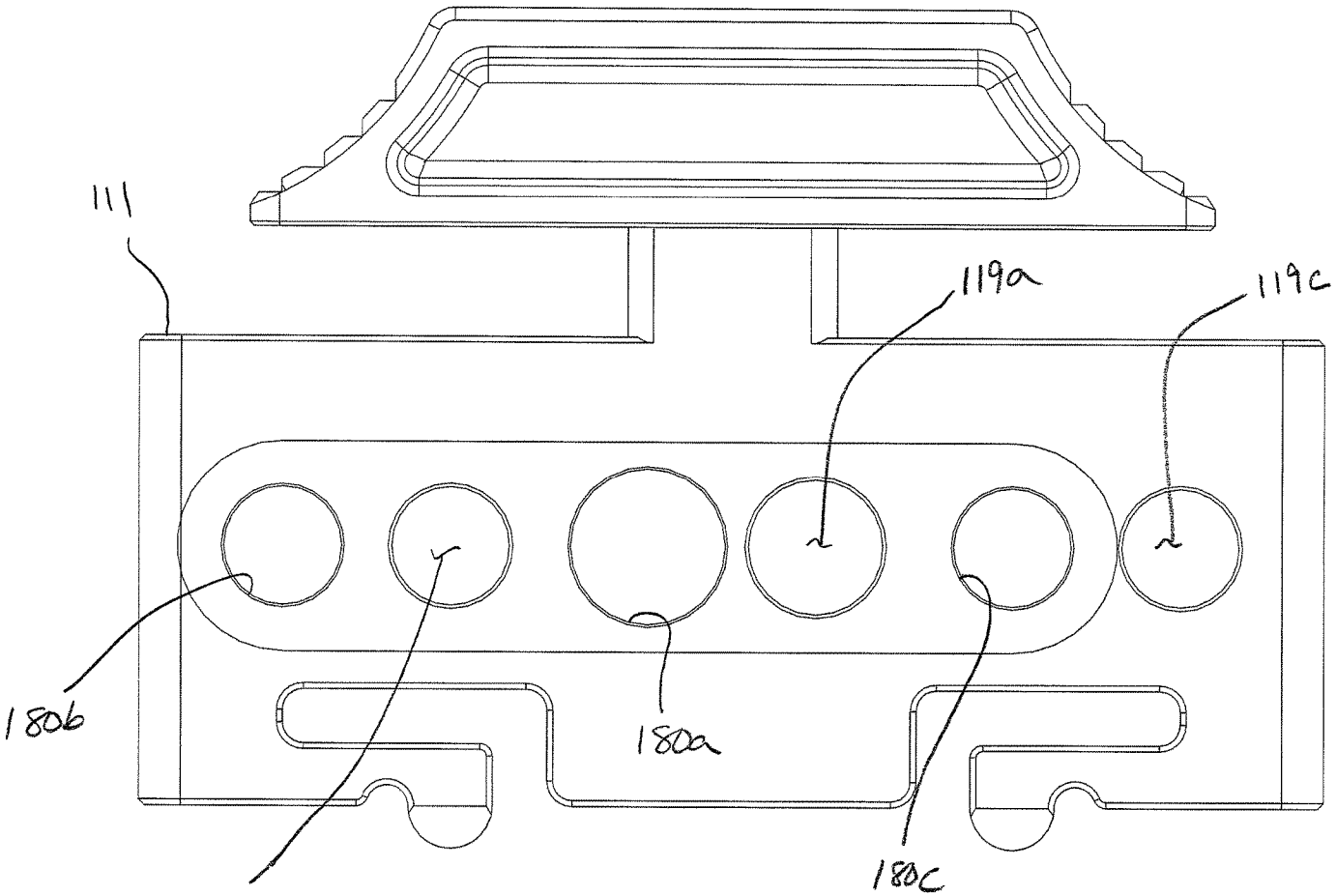
FIG. 21 is a rear view of the laser window and laser safety door.
Figure 22:
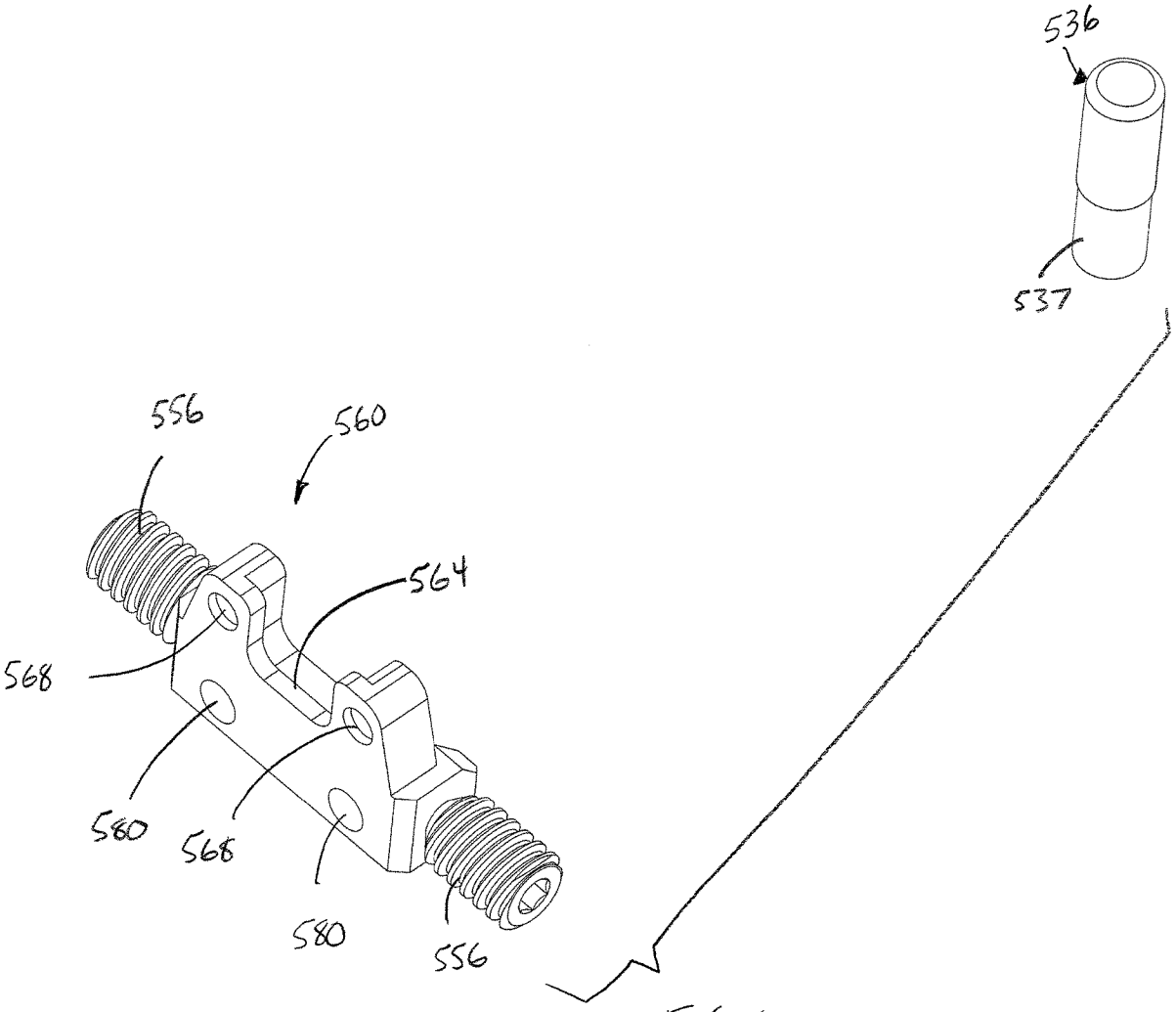
FIG. 22 is an isometric view of the adjustable front sight and the adjustable rear sight and adjustment screws.

In certain embodiments, the door is formed a material which is opaque with respect to the wavelength of light emitted by the lasers 176*a*-176*c* to thereby block laser emissions from the unit 100 when the door is in the closed position. Alternatively, as seen in FIG. 21, the door 111 may carry laser attenuators, e.g., optical attenuators, 119*a*, 119*b*, and 119*c* which are positioned on the door 111 so as to be disposed in the optical path of the lasers 176*a*-176*c* when the door is in the closed position to reduce the output intensity of the lasers to an eye safe level, e.g., when the unit 100 is used during training exercises as described in the aforementioned publication no. 2016/0102943. In alternative embodiments, a laser safety door may be hingedly be attached to the upper housing cover 161 and pivoted out of position when not in use, e.g., as shown in the aforementioned U.S. provisional application No. 62/279,244.

A laser window 120, which is transparent to the laser wavelengths of the lasers 176*a*-176*c*, may be provided between the laser tubes and the door 111 to prevent moisture or other environmental contamination from entering the unit 100 through the apertures 180*a*-180*c*. Alternatively, the transparent window could be provided on the outer surface of the door 111.

In certain embodiments, the laser bench 148 has a mounting block 204 to provide a flexible connection between the housing and the laser bench 148. The block 204 is secured to a forward facing surface of the bench 148 at a central position. An aperture 205 is formed in the block 204 to define an optical path for the laser 176*a*. In alternative embodiments, the mounting block may be attached to another portion of the laser bench which is not in the path of the lasers 176*a*, 176*b*, 176*c*, in which case the mounting block need not be provided with an aperture. The block 204 provides freedom of movement of the optical axis relative to the housing 160 in respect to at least two degrees of freedom consisting of pivotability about two orthogonal pivot axes as described in the aforementioned publication no. 2016/0102943.

In certain embodiments, the block 204 includes a first portion 206 attached to a portion of the laser bench and a second portion 208 flexibly attached to the housing. The first and second portions are flexibly attached to each other to permit a range of pivoting movement of the laser bench about a horizontal axis 209 and a vertical axis 211. In the illustrated embodiment, the block 204 includes a third portion 210 disposed between the first portion 206 and the second portion 208. The first portion and the third portion are spaced apart and connected via one or more flexible webs or hinges 212 which allow pivoting movement of the laser bench about the horizontal axis 209. The second portion and the third portion are spaced apart and connected via one or more flexible webs or hinges 213 which allow pivoting movement of the laser bench about the vertical axis 211.

The iron sights include a rear sight assembly 524 disposed at a rearward portion of the reflex base 116 and a front sight member 528 disposed toward the front of the reflex sight assembly 110, e.g., incorporated into the lens retainer 132. The front sight member includes a post 536 upstanding from a base 532 at a position that is generally centrally located between the left and right sides of the reflex sight assembly. In certain embodiments, the post 536 includes indicia (not shown), such as a dot having a contrasting color or painted with a luminescent paint.

The rear sight assembly 524 includes a bracket 544 having arms 548 spaced apart transversely with respect to a firing direction of the firearm. Each of the arms 548 includes a tapped opening 552 having a set screw 556 threadably received therein. A rear sight member 560 includes a notch or aperture 564 and is disposed between the arms 548. In certain embodiments, the rear sight member 560 includes indicia 568 such as dots having a contrasting color or painted with a luminescent paint.

The rear sight member 560 has a transverse width that is less than the distance between the inside edges of the arms 548 and the set screws 556 extend from the openings 552 into the opening or gap between the arms 548 and bear against the respective side of the rear sight member 560. By selectively advancing and retracting the set screws 556, the rear sight member 560 can be moved to a desired horizontal position with respect to the post 536, which, in turn, adjusts the point of impact.

One or more screws 572 pass through an elongate opening 576 in the bracket 544 and engage one or more complementary threaded openings 580 in the rear sight member 560. The screw(s) 572 are loosened to permit side-to-side adjustment of the rear sight member 560 using the set screws 556 and tightened to secure the rear sight member 560 at a desired position, i.e., after the rear sight has been coaligned with the reflex and laser sights.

In certain embodiments, it is contemplated that the front sight member 536 may have a fixed height, in which case the iron sights are coaligned (e.g., at the factory) with the reflex and laser sights for windage only. In certain embodiments, the front post 536 is height adjustable, thereby also allowing the reflex sight to be coaligned (e.g., at the factory) with the reflex and laser sights for elevation. In certain embodiments, the front post 536 includes a threaded end 537 engaging a threaded opening in the base 532 and is selectively raised and lowered by rotating the post in one direction or the other. Once the iron sight has been coaligned with the reflex and laser sights, the can be permanently secured within the base 532, e.g., using an adhesive.

The unit 100 may further include an interface 114 for securing the sight 100 to a portion of the firearm or other projectile weapon. In certain embodiments, the interface 114 is adapted to fasten the sight 100 to a "Picatinny" accessory rail 128, e.g., MIL-STD-1913, STANAG 2324, STANAG 4694 or the like. In certain embodiments, an adapter having rail clamp assembly may be provided to secure the unit 100 to an accessory rail interface.

Electronic and electrical components, such as switches, connectors, circuit boards, processing or control electronics, etc., are housed within the housing 160 for controlling operation of the light sources. Power may be supplied via an electrical connector 123 which, in turn, can be electrically coupled to a power source, such as a power source associated with a powered rail system of the weapon. In certain embodiments, one or more batteries or battery packs for operating the lasers 176*a*, 176*b*, 176*c*, the light source 122, and the associated electronics for controlling operation of the light sources may be provided within the unit 100.

Once the iron sight assembly is co-aligned with the co-aligned reflex and laser sights, it is normally not necessary for the user to separately adjust the position of the rear sight 560, light source 122, or alignment of the laser tubes. Thus, it is contemplated that the coalignment is preferably performed, e.g., by the manufacturer, prior to shipping to the end user. In this manner, windage and elevation adjustments can be made to the laser bench as a whole to simultaneously adjust the reflex sight, iron sights, and lasers relative to the barrel of the weapon with which the unit 100 is being used.

In certain embodiments, an upward vertical force is exerted on the laser bench 148 by springs, e.g., wave springs, 271 bearing against a lower surface of the bench 148, thereby tending to urge the rearward end of the laser bench 148 upward. In certain embodiments, a primary elevation adjustment assembly 270 includes a threaded, rotatable member 274 rotatably coupled to a complementary threaded housing adjustment member 275 coaxially disposed with respect to a pivot axis 290 of the lever, wherein the threaded member 274 is rotatable in one direction to advance a plunger 288 and rotatable in the other direction to retract the plunger 288 by rotating the threaded member 274 in the opposite direction to adjust the orientation of the laser bench within the housing. The bearing member 288 is disposed on the end of the rotatable member 274.

In the illustrated embodiment, the bearing member 288 of the elevation adjustment assembly 270 bears against a horizontal surface 276 of a lever 207 attached to the bench 148 and may be advanced or retracted for selectively moving the lever arm up or down to provide an elevation adjustment of the entire unit 100, including the coaligned laser, iron, and reflex sights, by pivoting the laser bench about the pivot axis 209. In certain embodiments, the elevation adjustment assembly may be, for example, as described in the aforementioned publication no. 2016/0102943.

Likewise, in certain embodiments, a horizontal force (e.g., rightward in the illustrated embodiment) is exerted on the laser bench 148 by a spring 272 bearing against a side surface (left side surface in the illustrated embodiment) of the lever 207, thereby tending to urge the rearward end of the laser bench 148 in the direction of the spring force. In certain embodiments, a windage adjustment assembly 273 includes a threaded member 277 rotatably coupled to a complementary threaded member 278 affixed relative to the housing, wherein the threaded member may be selectively advanced by rotating the threaded member 277 in one direction and retracted by rotating the threaded member 277 in the opposite direction to adjust the orientation of the laser bench within the housing. In the illustrated embodiment, the windage adjustment assembly bears against a vertical side surface 279 of the lever 207. In this manner, the windage adjustment assembly provides a windage adjustment of the entire unit 100 by pivoting the laser bench about the pivot axis 211. In certain embodiments, the windage adjustment assembly may be, for example, as described in the aforementioned publication no. 2016/0102943.

In certain embodiments, a macro elevation adjustment assembly is provided. In certain embodiments, the macro elevation adjustment assembly may be as detailed in the aforementioned publication no. 2016/0102943, e.g., to quickly adjust for different types of ammunition rounds (e.g., when switching between high velocity and subsonic rounds) and/or different shooting scenarios.

Figure 13:
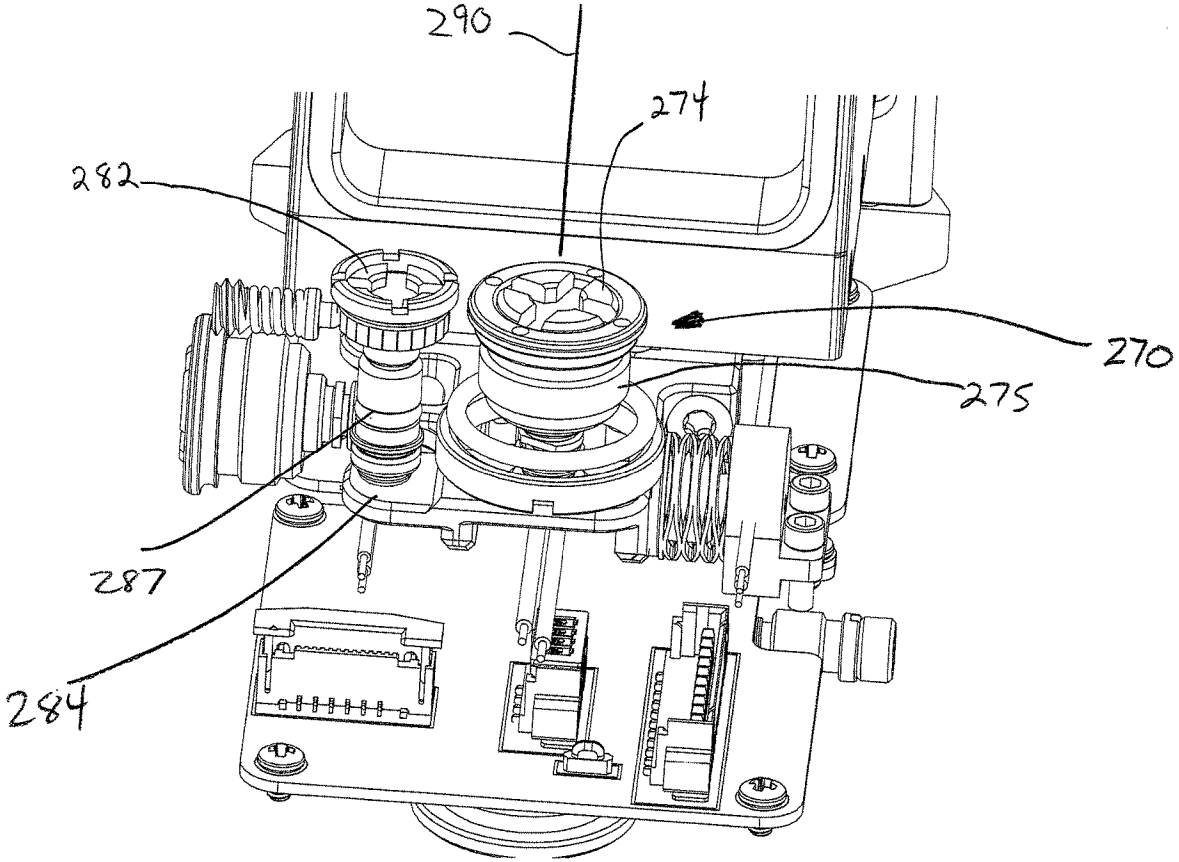
FIG. 13 is a rear view of the sight taken generally from, with the lever housing removed, illustrating the primary elevation adjustment assembly and the secondary elevation adjustment assembly.
Figure 14:
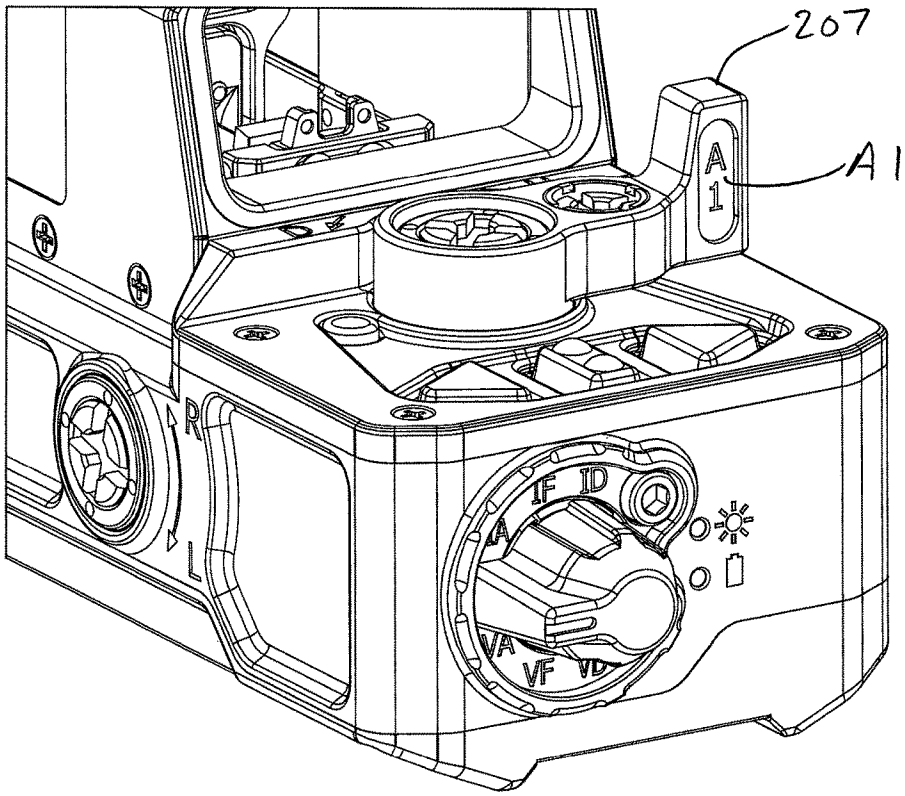
FIG. 14 is a fragmentary, rear, isometric view of the unit appearing in FIG. 1, wherein the elevation adjustment lever is moved to the left side position.
Figure 15:
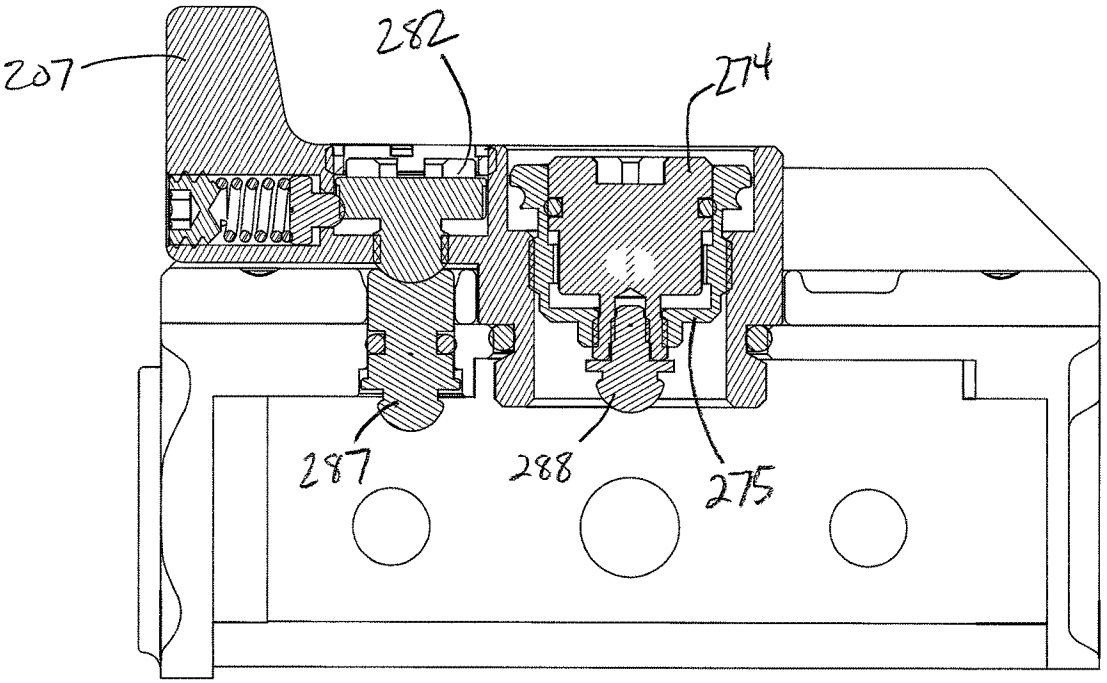
FIG. 15 is a cross-sectional view illustrating the elevation adjustment assembly.
Figure 16:
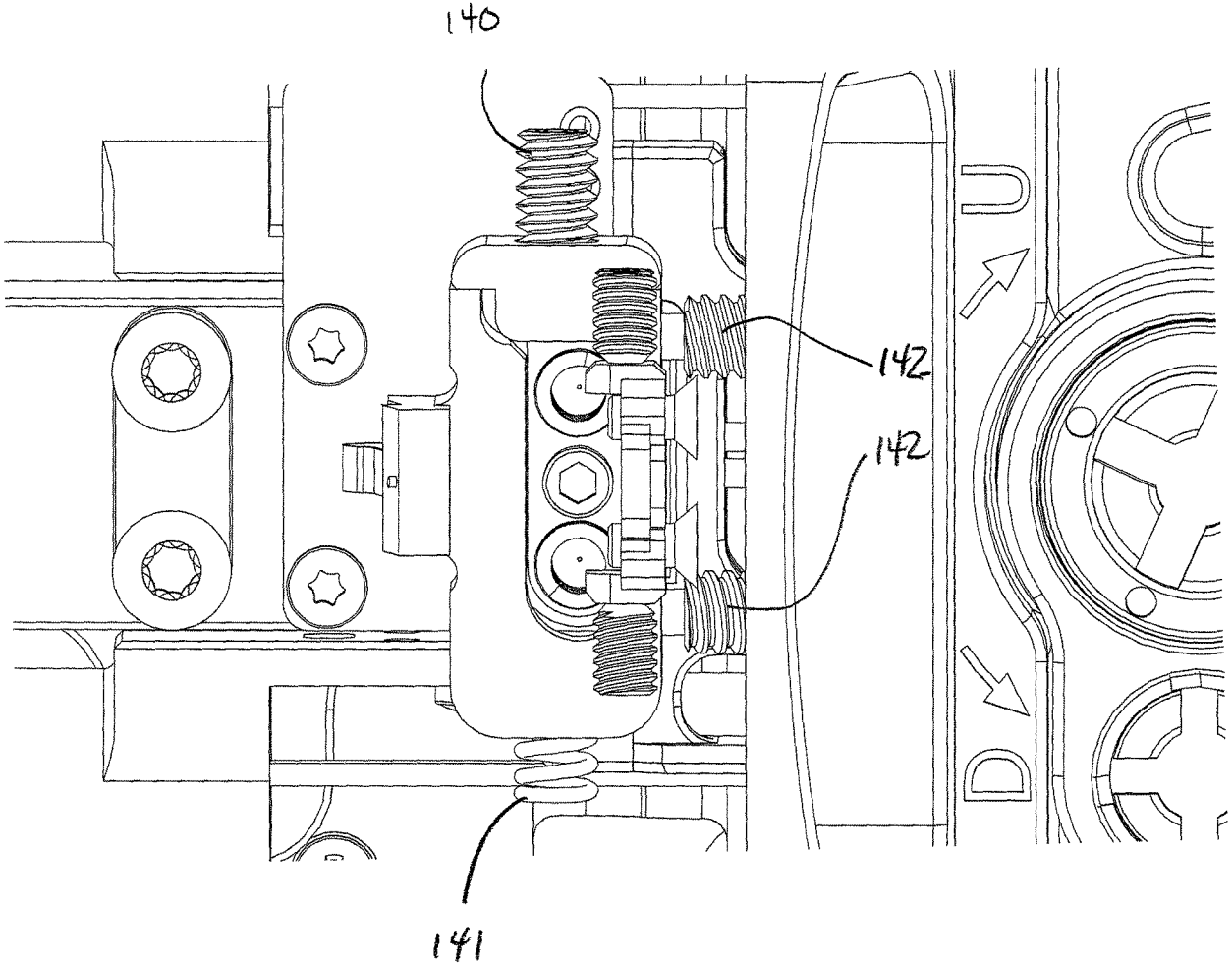
FIG. 16 is a fragmentary top view of the reflex sight assembly with the reflex sight assembly base removed.
Figure 25:
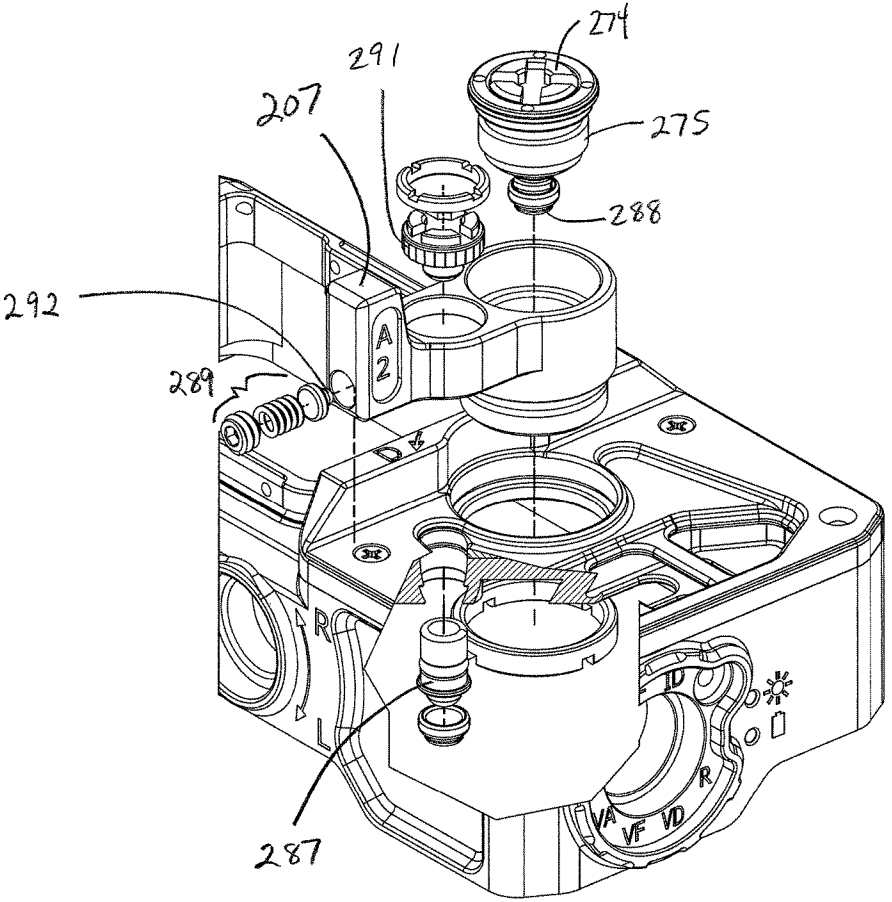
FIG. 25 is a partially exploded isometric view showing the elevation adjustment assembly.

In the illustrated embodiment, as best seen in FIGS. 13, 15, and 25, a secondary elevation adjustment assembly 280 is disposed in a lever 281 which is pivotally attached to the housing. The secondary elevation adjustment assembly 280 includes a threaded rotatable member 282 threadably received within a complementary opening 283 in the lever 281. The end of the member 282 bears against an axially movable plunger 287. The plunger, in turn, bears against a horizontal surface 284. The threaded member 282 is selectively advanced by rotating the threaded member 282 in one direction and retracted by rotating the threaded member 282 in the opposite direction to adjust the axial position of the plunger 287. A detent assembly 289 is disposed in the lever arm 207 and includes a biased detent member 292 which resiliently engages scallops 291 in the side of the member 282 to provide positive retention of the member 282 at the desired rotational position and to provide an audible and/or tactile click for each angular increment of rotation when adjusting the A2 elevation setting.

In operation, when the lever is thrown to the right, as shown, e.g., in FIGS. 13 and 15, the plunger 287 bears against a horizontal surface 284 on the lever 207, which in turn, is attached to the laser bench 148. Because the surface 284 is slightly elevated with respect to the surface 276, when the lever is in the right-side position wherein the secondary elevation adjustment assembly 280 engages the elevated surface 284, it pushes the lever 207 downward, thereby adjusting the aim point upward. This downward movement of the lever 207 causes the primary elevation adjustment assembly 270 to be disengaged from the surface 276. Thus, the elevation of the aim point is raised when it engages the bearing surface 284 and can be fine-tuned by rotating the rotatable member 282, e.g., to accommodate a particular ammunition type (e.g., a lower speed, e.g., subsonic, ammunition having a greater ballistic drop) or shooting scenario.

When the lever is then rotated 180 degrees (see FIG. 14), the elevation adjustment assembly 280 disengages from the lever 207 and the lever 207 is urged upward by the springs 271, thereby lowering the aim point, until the surface 276 reengages the primary elevation adjustment assembly 270 engages the surface 276. Thus, the elevation setting is governed by the assembly 270 and the aim point is lowered. The elevation adjustment in this lower setting is can be fine-tuned by rotating the rotatable member 274, e.g., to a particular ammunition type (i.e., a high speed, e.g., supersonic, ammunition with lower ballistic drop) or shooting scenario.

In certain embodiments, the lever is provided with indicia (e.g. A1, A2) disposed on opposite sides of the lever 207, such that the indicia that is visible to the user when using the sight (i.e., when the sight is viewed from the rear), indicates the ammunition type that corresponds to the current lever position.

Figure 23:
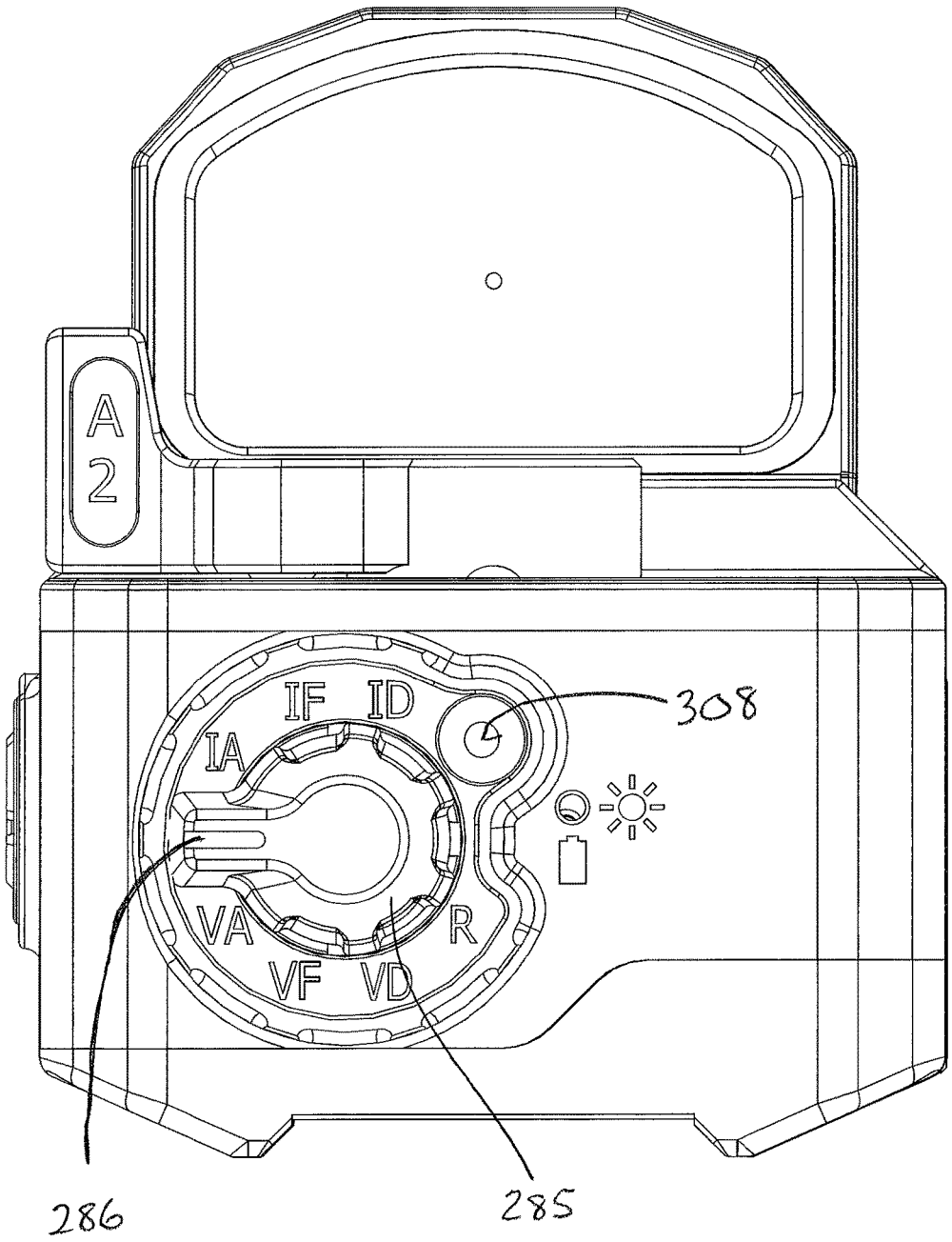
FIG. 23 is a rear view of the combined laser and reflex aiming sight with integrated iron sights appearing in FIG. 1.

As best seen in FIG. 23, the rear surface of the housing 160 includes a selector switch 285 for selecting a mode of operation of the unit 100. In certain embodiments, the selector switch includes a rotary knob although other switch types are contemplated. In the illustrated embodiment the switch 285 is rotatable from a powered "off" position as shown in FIG. 23 to a position corresponding to the desired operation of the unit 100, e.g., by aligning indicia 286 on the knob with indicia corresponding to a mode of operation of the unit 100.

In certain embodiments, the modes of operation include an infrared laser aiming mode which is accessed by rotating the knob 285 to the position IA. In the infrared laser aiming mode, the infrared laser 176*c* is actuated when manual actuator button 177 is depressed.

In certain embodiments, another mode of operation includes a visible laser aiming mode which is accessed by rotating the knob 285 to the position VA. In the visible laser aiming mode, the visible laser 176*b* is actuated when the manual actuator button 177 is depressed.

In certain embodiments, another mode of operation includes a visible flash mode which is accessed by rotating the knob 285 to the position VF. In the visible flash mode, the visible laser 176*b* is actuated in a flash or strobe pattern when the manual actuator button 177 is depressed.

In certain embodiments, another mode of operation includes an IR flood mode which is accessed by rotating the knob 285 to the position IF. In the IR flood mode, the infrared illuminator laser 176*a* is actuated when the manual actuator button 177 is depressed.

In certain embodiments, another mode of operation includes an IR dual mode which is accessed by rotating the knob 285 to the position ID. In the IR dual mode, the infrared illuminator laser 176*a* and the infrared aiming laser 176*c* are both actuated when the manual actuator button 177 is depressed to produce an IR spot within the center of an IR flood beam.

In certain embodiments, another mode of operation includes a visible dual mode which is accessed by rotating the knob 285 to the position VD. In the visible dual mode, the infrared illuminator laser 176*a* and the visible aiming laser 176*b* are both actuated when the manual actuator button 177 is depressed to produce a visible spot within the center of an IR flood beam.

In certain embodiments, another mode of operation includes a reflex only mode which is accessed by rotating the knob 285 to the position R. In the reflex only mode, the unit operates as a reflex sight, i.e., the lasers 176*a*-176*c* are inactive and only the light source 122 of the reflex sight assembly 110 is active.

In certain embodiments, the actuator button 177 is a part of a key pad 183 which includes laser power increment and decrement buttons 185 and 186, respectively, which allow the user to selectively increase or decrease the intensity of the lasers 176*a*-176*c* to a desired level.

Figure 24:
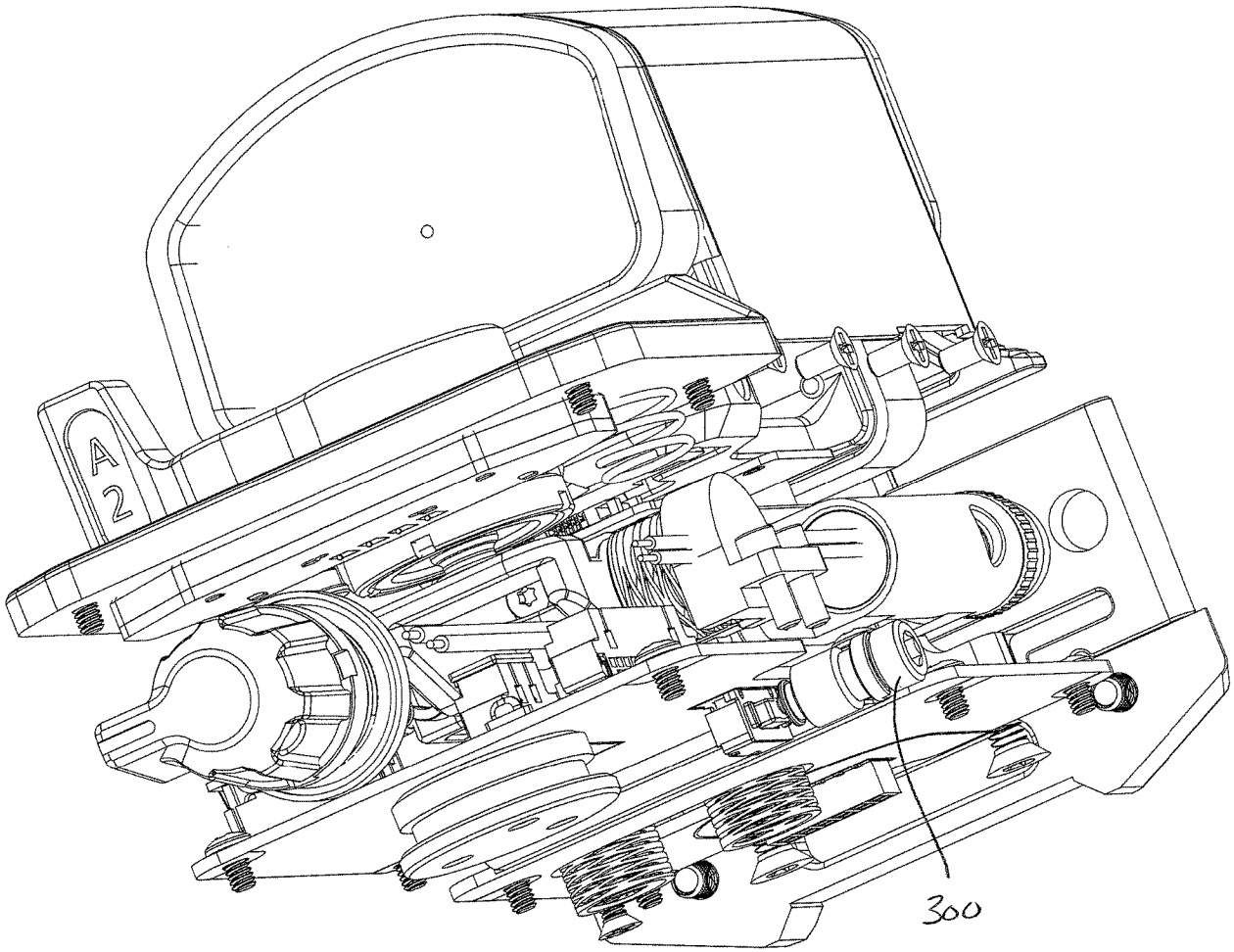
FIG. 24 is an isometric view illustrating a high power mode activation switch engaged by a lockout screw, the lower housing cover being removed for ease of exposition.

As best seen in FIG. 24, a threaded lockout screw 300 engages a complementary threaded opening 302 in the housing shell (omitted in FIG. 24 for ease of illustration). Rotatably advancing the screw 300 causes a movable plunger 304 to move into engagement with a switch 306 which controls the power output of the lasers 176*a*-176*c*. In certain embodiments, when the screw 300 is fully advanced into the opening 302, the plunger 304 closes the switch 306, thereby enabling the lasers to operate in a high power mode and when the screw 300 is removed from the opening 302, the switch 306 opens, thereby preventing the lasers from operating in a high power mode.

The switch 306 is coupled to circuitry positioned within in the housing, for controlling the power output of the lasers 176*a*-176*c* to a level of intensity below a predetermined intensity threshold, e.g., below a threshold intensity at which permanent eye damage occurs.

In certain embodiments, when the screw 300 is received within the opening 302, it allows the user to access the high laser power levels, e.g., using the laser power increment button 185. In alternative embodiments, other methods for selecting high laser power modes of operation are contemplated. For example, it is contemplated that the unit 100 could have a dedicated high and low power selector, wherein the high power selector is disabled unless the screw 300 is received within the opening 302.

In certain embodiments, a threaded opening 308 may be provided on the housing of the unit 100 for storing and preventing loss the screw 300 when the screw is not received in the opening 302, i.e., when high power laser intensity levels are not intended.

In certain embodiments, it is contemplated that the screw 300 has a keyed configuration such that a special key or removal tool is required for its insertion and/or removal.

In alternative embodiments, the function of the threaded lockout screw 300 when it engages the complementary threaded opening 302 could be reversed, that is, the presence of the screw 300 and actuation of the switch serves to prevent operation of the lasers 176*a*-176*c* at high power levels and removal of the screw 300 from the opening 302 allows the lasers 176*a*-176*c* to be operated at high power levels.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. An elevation adjustment apparatus for adjusting an aim point of a laser sight, the elevation adjustment apparatus comprising:

a throw lever configured to be pivotally attached to a housing of a laser sight, the throw lever movable between a first position and a second position;

a primary adjustment assembly configured to engage a laser bench movably secured within the housing to adjust an aim point of the laser sight to a first vertical position when the throw lever is in the first position; and a secondary adjustment assembly configured to engage the laser bench to adjust the aim point of the laser sight to a second vertical position when the throw lever is in the second position, the secondary adjustment assembly configured to disengage the laser bench when the throw lever is in the first position.

2. The elevation adjustment apparatus of claim 1, wherein the primary adjustment assembly is coaxial with a pivot axis of the throw lever and the secondary adjustment assembly is carried on an arm of the throw lever and is displaced from the pivot axis of the throw lever.

3. The elevation adjustment apparatus of claim 2, wherein the primary adjustment assembly includes a first bearing member which engages a first bearing surface attached to the laser bench when the throw lever is in the first position and further wherein the secondary adjustment assembly includes a second bearing member which engages a second bearing surface attached to the laser bench when the throw lever is in the first position.

4. The elevation adjustment apparatus of claim 2, wherein the first bearing surface and the second bearing surface are axially displaced with respect to the pivot axis.

5. An elevation adjustment apparatus for adjusting an aim point of a laser sight, the elevation adjustment apparatus comprising:

a throw lever configured to be pivotally attached to a housing of a laser sight, the throw lever movable between a first position and a second position;

a primary adjustment assembly configured to engage a laser bench movably secured within the housing to adjust an aim point of the laser sight to a first vertical position when the throw lever is in the first position; and a secondary adjustment assembly configured to engage the laser bench to adjust the aim point of the laser sight to a second vertical position when the throw lever is in the second position;

wherein the primary adjustment assembly is coaxial with a pivot axis of the throw lever and the secondary adjustment assembly is carried on an arm of the throw lever and is displaced from the pivot axis of the throw lever.

6. The elevation adjustment apparatus of claim 5, wherein the primary adjustment assembly includes a first bearing member which engages a first bearing surface attached to the laser bench when the throw lever is in the first position and further wherein the secondary adjustment assembly includes a second bearing member which engages a second bearing surface attached to the laser bench when the throw lever is in the first position.

7. The elevation adjustment apparatus of claim 5, wherein the first bearing surface and the second bearing surface are axially displaced with respect to the pivot axis.

* * * * *